US008708452B2

(12) United States Patent
Shimizu et al.

(10) Patent No.: US 8,708,452 B2
(45) Date of Patent: Apr. 29, 2014

(54) LIQUID EJECTION APPARATUS

(71) Applicants: Seiji Shimizu, Ogaki (JP); Yoshihumi Suzuki, Ena (JP); Atsushi Hirota, Nagoya (JP)

(72) Inventors: Seiji Shimizu, Ogaki (JP); Yoshihumi Suzuki, Ena (JP); Atsushi Hirota, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/841,644

(22) Filed: Mar. 15, 2013

(65) Prior Publication Data

US 2013/0241992 A1 Sep. 19, 2013

(30) Foreign Application Priority Data

Mar. 16, 2012 (JP) ..... 2012-060841

(51) Int. Cl.
*B41J 2/165* (2006.01)

(52) U.S. Cl.
USPC ..... 347/29

(58) Field of Classification Search
USPC ..... 347/22, 25, 29
See application file for complete search history.

(56) References Cited

U.S. PATENT DOCUMENTS

| | | | | |
|---|---|---|---|---|
| 5,793,389 | A * | 8/1998 | Mitchell | 347/28 |
| 7,384,119 | B2 * | 6/2008 | Karppinen et al. | 347/25 |
| 2011/0109690 | A1 | 5/2011 | Kida et al. | |
| 2011/0242204 | A1 | 10/2011 | Shinoda | |

FOREIGN PATENT DOCUMENTS

| | | | |
|---|---|---|---|
| GB | 2280149 | A | 1/1995 |
| JP | 2000-079696 | A | 3/2000 |
| JP | 2005-271314 | A | 10/2005 |
| JP | 2007-307865 | A | 11/2007 |
| JP | 2011-207091 | A | 10/2011 |

OTHER PUBLICATIONS

European Patent Office, Extended European Search Report for European Patent Application No. 13159588.6 (counterpart to above-captioned patent application), mailed Jun. 10, 2013.

* cited by examiner

*Primary Examiner* — Lamson Nguyen
(74) *Attorney, Agent, or Firm* — Merchant & Gould P.C.

(57) ABSTRACT

A liquid ejection apparatus includes: a head comprising ejection openings opposed to an ejection space; a cap mechanism which switches the ejection space between a closed state and an open state; a first supply opening portion communicating with the ejection space being in the closed state, a second supply opening portion communicating with the ejection space being in the open state; and a humidifying mechanism configured to supply humid air to at least one of the first and second supply opening portions. In the closed state, an amount of the humid air supplied to the first supply opening portion is greater than that of the humid air supplied to the second supply opening portion. In the open state, an amount of the humid air supplied to the second supply opening portion is greater than that of the humid air supplied to the first supply opening portion.

14 Claims, 10 Drawing Sheets

LIQUID EJECTION APPARATUS

CROSS REFERENCE TO RELATED APPLICATION

The present application claims priority from Japanese Patent Application No. 2012-060841, which was filed on Mar. 16, 2012, the disclosure of which is herein incorporated by reference in its entirety.

BACKGROUND

1. Field of the Invention

The present invention relates to a liquid ejection apparatus configured to eject liquid such as ink.

2. Description of the Related Art

There is conventionally known a liquid ejection apparatus including a head elongated in a longitudinal direction perpendicular to a conveying direction in which a recording medium is conveyed, and the head has an ejection face in which a plurality of ejection openings are formed for ejecting liquid onto the recording medium. There is also known a technique of supplying humid air to the ejection openings in this liquid ejection apparatus in order to reduce an amount of increase in viscosity of the liquid in the ejection openings (hereinafter may be referred to as "drying of the ejection openings").

As the above-described liquid ejection apparatus, there is known a liquid ejection apparatus in which, when the head is not used, a space opposed to the ejection face is capped or isolated from an outside space, and then the space is humidified. This humidifying maintenance is performed by discharging air from the ejection space through an air discharge opening communicating with the ejection space and by supplying humid air into the ejection space through an air supply opening communicating with the ejection space.

SUMMARY

Incidentally, in order to suppress the drying of the ejection openings, there is known a technique of performing flushing to discharge ink form ejection openings that have not been used for ink ejection for a specific set length of time when the ink-jet head is used (i.e., in image recording on the recording medium). However, such flushing increases consumption of the ink unfortunately.

This invention has been developed to provide a liquid ejection apparatus capable of reducing consumption of liquid and suppressing drying of ejection openings.

The present invention provides a liquid ejection apparatus, comprising: a head elongated in a longitudinal direction perpendicular to a conveying direction in which a recording medium is conveyed, the head comprising: an upstream side face in the conveying direction; and an ejection face comprising a plurality of ejection openings, the head being configured to eject liquid onto the recording medium from the plurality of ejection openings, an ejection space being opposed to the plurality of ejection openings; a cap mechanism comprising: a facing member capable of facing the ejection face; and a separator capable of separating the ejection space and an outside space, the cap mechanism being configured to switch a state of the ejection space between a closed state in which the ejection space is enclosed with the ejection face, the facing member, and the separator and an open state in which the ejection space is open to the outside space; a first supply opening portion and a discharge opening portion each communicating with the ejection space being in the closed state, the first supply opening portion and the discharge opening portion being arranged on opposite sides of the plurality of ejection openings in the longitudinal direction when viewed in a direction perpendicular to the ejection face; a second supply opening portion provided along the upstream side face of the head and communicating with the ejection space being in the open state; a humidifying mechanism configured to supply humid air to at least one of the first supply opening portion and the second supply opening portion, wherein, when the ejection space is in the closed state, an amount of the humid air supplied to the first supply opening portion is greater than that of the humid air supplied to the second supply opening portion, and wherein, when the ejection space is in the open state, an amount of the humid air supplied to the second supply opening portion is greater than that of the humid air supplied to the first supply opening portion.

BRIEF DESCRIPTION OF THE DRAWINGS

The objects, features, advantages, and technical and industrial significance of the present invention will be better understood by reading the following detailed description of embodiments of the invention, when considered in connection with the accompanying drawings, in which:

FIGS. 10A and 10B are partial cross-sectional views taken along line B-B in FIG. 9A, wherein FIG. 10A is a partial cross-sectional view in the nonoperating-state humidifying operation, and FIG. 10B is a partial cross-sectional view in the recording-state humidifying operation.

DETAILED DESCRIPTION OF THE EMBODIMENTS

Hereinafter, there will be described embodiments of the present invention by reference to the drawings.

First Embodiment

Figure 1:
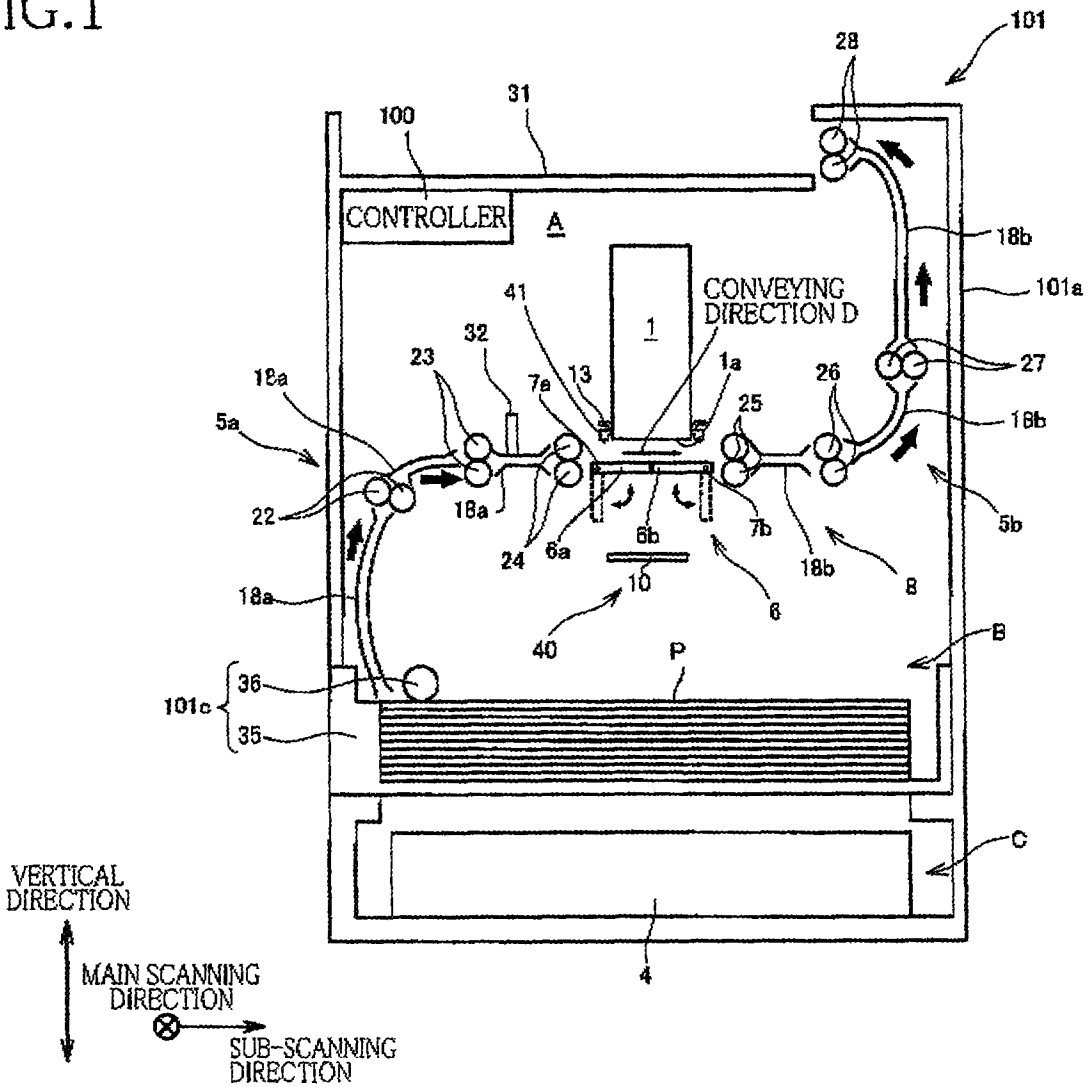
FIG. 1 is a side view generally illustrating an internal structure of an ink-jet printer as one example of a liquid ejection apparatus according to a first embodiment of the present invention.

First, there will be explained, with reference to FIG. 1, an overall structure of an ink-jet printer 101 as one example of a liquid ejection apparatus according to a first embodiment of the present invention.

The printer 101 includes a housing 101*a* having a rectangular parallelepiped shape. A sheet-output portion 31 is provided on a top plate of the housing 101*a*. An inner space of the housing 101*a* can be divided into spaces A, B, C in order from an upper side thereof. Formed in the spaces A, B is a sheet conveyance path that extends from a sheet-supply portion 101*c* to the sheet-output portion 31. A recording medium in the form of a sheet P is conveyed through this sheet conveyance path along bold arrows illustrated in FIG. 1. In the space A, image recording on the sheet P and the conveyance of the sheet P to the sheet-output portion 31 are performed. In the space B, the sheet P is supplied to the conveyance path. Mounted in the space C is a cartridge 4 from which ink is supplied toward an ink-jet head 1 provided in the space A.

Devices and components provided in the space A include: the head 1 configured to eject black ink; a conveyor mechanism 8; a cap mechanism 40; a sheet sensor 32; a humidifying mechanism 50 (see FIG. 4) used for a humidifying operation; and a controller 100.

The head 1 has a generally rectangular parallelepiped shape elongated in a main scanning direction as its longitudinal direction (see FIG. 2). The head 1 is supported by the housing 101*a* via a head holder 13 and opposed to platens 6*a*, 6*b* with a predetermined space therebetween. The head 1 is a stacked body including a head main body 3 (see FIG. 2), a reservoir unit, a flexible printed circuit (FPC), and a circuit board. In the reservoir unit as an upstream channel member is formed an upstream ink channel, not shown, having a reservoir, not shown. The ink is supplied from the cartridge 4 to this upstream ink channel.

The head main body 3 includes actuator units 21 and a channel unit 9 as a downstream channel member, and the ink in the reservoir unit is supplied into this channel unit 9 from ink supply openings 105*b* formed in an upper face of the channel unit 9. A lower face of the channel unit 9 is an ejection face 1*a* having a multiplicity of ejection openings 108 formed therein. The ink is ejected from these ejection openings 108 by drivings of the actuator units 21.

The circuit board adjusts signals received from the controller 100. The output signal is converted by a driver IC provided on the FPC, to a drive signal that is output to the actuator unit 21 of the head main body 3. When the drive signal is supplied to the actuator unit 21, this actuator unit 21 is deformed to apply a pressure to the ink in the channel unit 9. The head 1 will be explained later in detail.

In addition to the head 1, a separator 41 of the cap mechanism 40 is mounted on the head holder 13. This separator 41 is provided on the head 1 so as to enclose the head 1 in plan view. Like the head 1, the separator 41 has a generally rectangular parallelepiped shape elongated in the main scanning direction as its longitudinal direction. The cap mechanism 40 will be explained later in detail.

The conveyor mechanism 8 includes: two guide portions 5*a*, 5*b* for guiding the sheet P; and a supporting mechanism 6 and defines the sheet conveyance path. The two guide portions 5*a*, 5*b* are respectively arranged on opposite sides of the supporting mechanism 6 (i.e., the two platens 6*a*, 6*b*). The upstream guide portion 5*a* in the conveying direction includes three guides 18*a* and three conveyor roller pairs 22-24 and connects between the sheet-supply portion 101*c* and the platens 6*a*, 6*b*. The sheet P for image recording is conveyed toward the platens 6*a*, 6*b* while guided by this upstream guide portion 5*a*. The downstream guide portion 5*b* in the conveying direction includes three guides 18*b* and four conveyor roller pairs 25-28 and connects between the platens 6*a*, 6*b* and the sheet-output portion 31. After the image recording, the sheet P is conveyed toward the sheet-output portion 31 while guided by this downstream guide portion 5*b*.

The supporting mechanism 6 supports the conveyed sheet P from its lower side during the image recording. The supporting mechanism 6 includes the two platens 6*a*, 6*b* and a drive motor, not shown, for pivoting these platens 6*a*, 6*b*. The two platens 6*a*, 6*b* respectively have pivot shafts 7*a*, 7*b* each extending in the main scanning direction. Under the control of the controller 100, the two platens 6*a*, 6*b* are pivoted by the drive motor between a support-face forming position and an open position. At the support-face forming position indicated by solid lines in FIG. 1, the two platens 6*a*, 6*b* extend horizontally, with their distal ends facing each other. At the open position illustrated in FIG. 7B, the two platens 6*a*, 6*b* extend downward such that their upper faces are parallel to each other. It is noted that the two platens 6*a*, 6*b* are normally located at the support-face forming position and located at the open position in a maintenance operation.

The sheet sensor 32 is disposed upstream of a conveyor roller pair 24 in the conveying direction to sense a leading edge of the sheet P. Upon the sense of the sheet P, the sheet sensor 32 outputs a sense signal that is used for driving the head 1 and the conveyor mechanism 8, enabling image recording at desired speed and resolution.

The humidifying mechanism 50 supplies humid air to the ejection openings 108 in a capping state and an uncapping state. The humidifying mechanism 50 is constituted by a humid-air producing portion and a humid-air supplying portion. The humid-air producing portion produces humid air and delivers it to the humid-air supplying portion. The humid-air supplying portion receives the delivered humid air and supplies the humid air to the ejection openings 108 to humidify the ejection openings 108. As illustrated in FIG. 4, the humid-air producing portion includes tubes 53-56, a tank 57, a pump 58, and a three-way valve 59. As illustrated in FIG. 2B, the humid-air supplying portion includes a supply pipe 60 and a part of the cap mechanism 40 which will be described below, e.g., a facing member 10 and the separator 41. The tank 57 is a production source of the humid air. In the humidifying operation, the pump 58 is driven to supply the humid air from the supply pipe 60 to vicinities of the ejection openings 108 via the tubes 53, 54, 56.

Figure 4A:
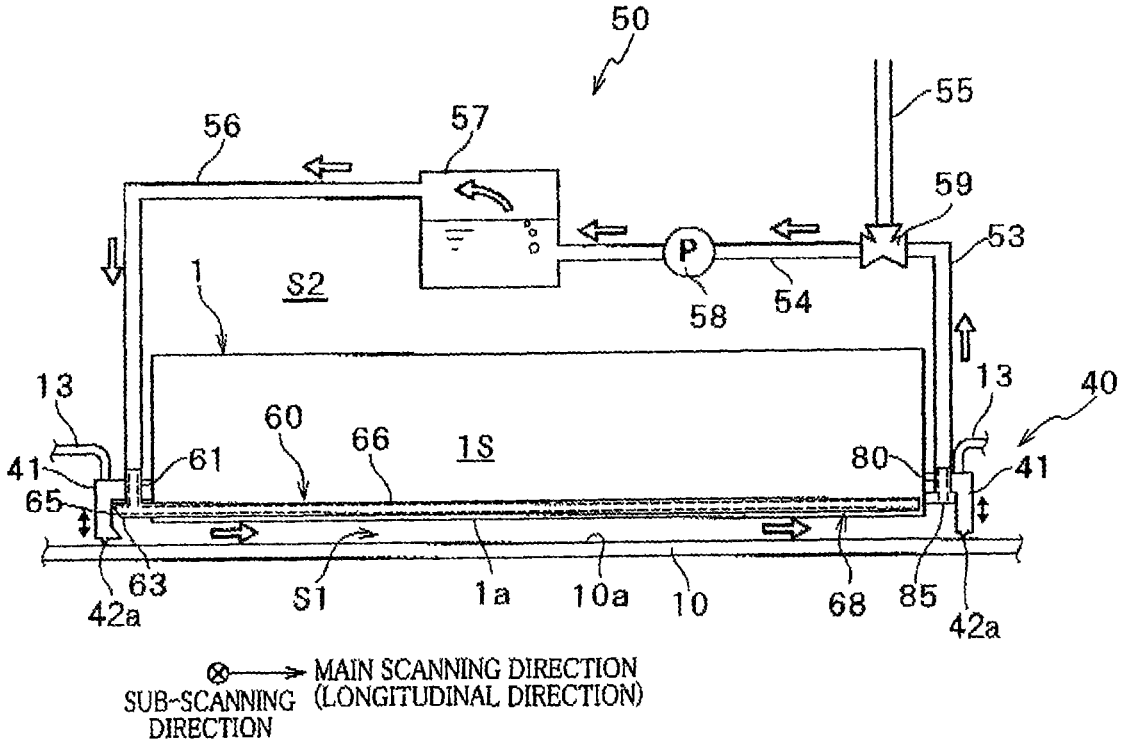
FIGS. 4A and 4B are schematic views each illustrating a head holder and a humidifying mechanism in the printer illustrated in FIG. 1.
Figure 4B:
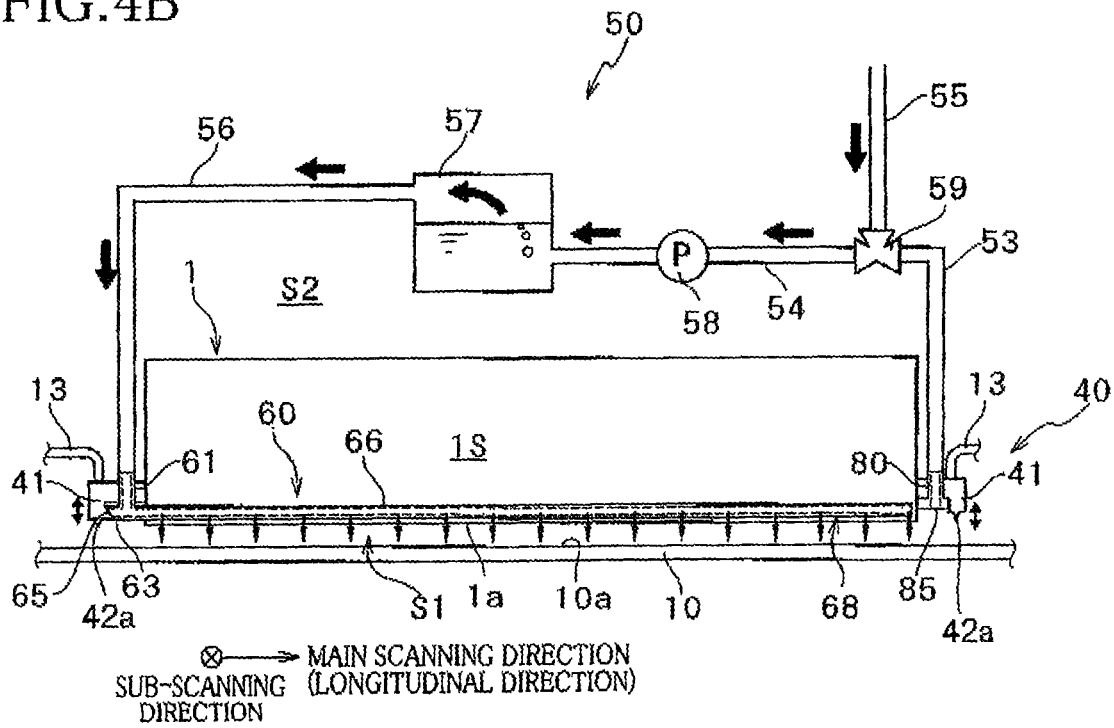

As illustrated in FIGS. 2B, 4A, and 4B, the humidifying mechanism 50 includes a first supply opening portion 65, a second supply opening portion 68, and a discharge opening portion 85. The first supply opening portion 65 and the discharge opening portion 85 are respectively arranged on opposite sides of the ejection openings 108 in the longitudinal direction, i.e., the main scanning direction when seen in a direction perpendicular to the ejection face 1*a*. The first supply opening portion 65 and the discharge opening portion 85 communicate with an ejection space S1 being in its closed state or a capped state, which will be described below. The ejection space S1 is a space between the ejection face 1*a* and the facing member 10 which will be described below. The second supply opening portion 68 extends in the longitudinal direction along an upstream side face 1S of the head main body 3 in a conveying direction 1 indicated in FIG. 1. The humidifying mechanism 50 selectively supplies the humid air to at least one of the first supply opening portion 65 and the second supply opening portion 68.

Figure 3A:
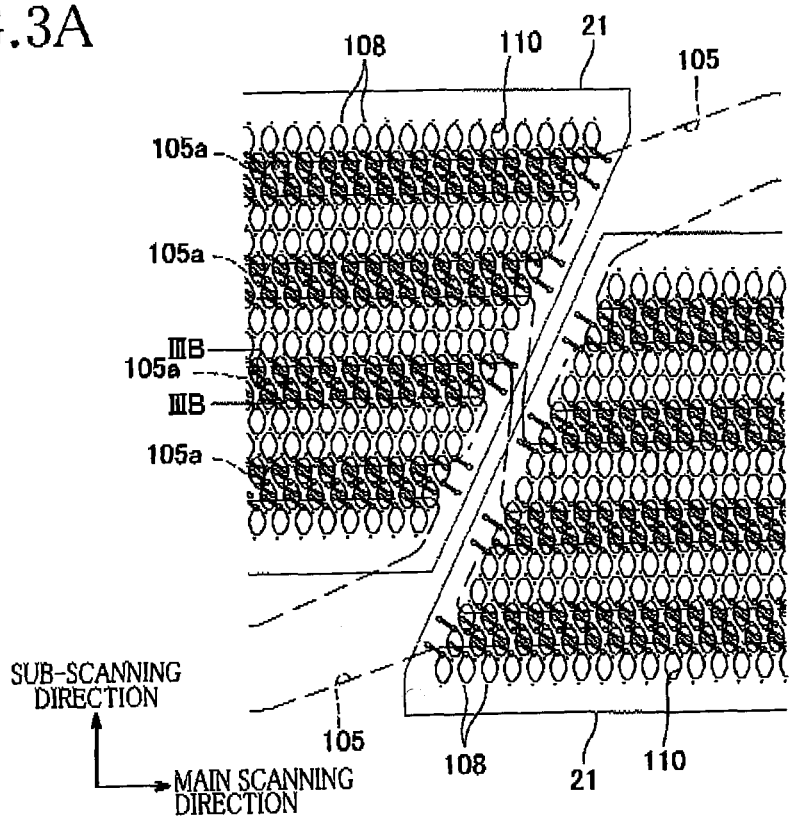
FIG. 3A is an enlarged view illustrating an area IIIA enclosed by one-dot chain line in FIG. 2A.

Returning to FIG. 3, the sheet-supply portion 101*c* is disposed in the space B. The sheet-supply portion 101*c* includes: a sheet-supply tray 35 and the sheet-supply roller 36. The sheet-supply tray 35 is removably mounted on the housing 101*a*. A plurality of sheets P are accommodated in the sheet-supply tray 35. The sheet-supply roller 36 supplies an uppermost one of the sheets P on the sheet-supply tray 35.

Here, a sub-scanning direction is a direction parallel to the conveying direction D in which the sheet P is conveyed by the conveyor roller pairs 24, 25, and the main scanning direction is a direction parallel to a horizontal plane and perpendicular to the sub-scanning direction.

In the space C, the cartridge 4 storing the black ink is removably mounted on the housing 101*a*. The cartridge 4 is coupled to the head 1 by a tube, not shown, and a pump, not shown. It is noted that the pump is driven in forcible delivery of the ink to the head 1 (e.g., in a purging operation and initial supply of the liquid) and stopped in the other situations so as not to inhibit the ink supply to the head 1.

There will be next explained the controller 100. The controller 100 controls the image recording operation and the maintenance operation, for example. In the image recording operation, the controller 100 controls, e.g., the sheet-supply portion 101*c*, the guide portions 5*a*, 5*b* (i.e., the conveyor mechanism 8), and the head 1 on the basis of a recording command and image data received from an external device such as a PC coupled to the printer 101. Specifically, the sheet P is supplied from the sheet-supply tray 35 to a recording area opposed to the head 1. When the sheet P reaches this recording area, the head 1 is driven in accordance with the sense signal output from the sheet sensor 32. When the sheet P is conveyed at a position just under the head 1, the ink is ejected to record a desired image on the sheet P. The sheet P is then conveyed and discharged onto the sheet-output portion 31.

The maintenance operation includes: a liquid discharge operation such as a purging operation and a flushing operation; a capping operation, and the humidifying operation which are performed regularly or in response to a user's request. These operations are performed for maintaining or recovering liquid ejection characteristics of the head 1.

For example, in the liquid discharge operation, the controller 100 controls the head 1 to discharge, from the ejection openings 108, the ink whose viscosity has been increased. In the purging operation, the controller 100 controls the head 1 to forcibly discharge the ink by applying a pressure to the ink without driving of an actuator. After this forcible discharge, a cleaning or a wiping operation is performed on the ejection face 1*a*. In the flushing operation, the actuator is driven to eject a specific set amount of ink droplets from the head 1. The driving of the actuator is based on flushing data that differs from the image data.

The capping operation is performed when the head 1 is at rest or not operated. In this capping operation, as illustrated in FIG. 4A, the facing member 10 faces the ejection face 1*a* with the ejection space S1 interposed therebetween, and the separator 41 separates the ejection space S1 and an outside space S2 so as to isolate the ejection space S1 from the outside space S2. The ejection openings 108 communicate only with the closed ejection space S1. As a result, a passage for releasing water of the ink in each ejection opening 108 is closed, which suppresses the increase in viscosity and drying of the ink.

The humidifying operation includes: a nonoperating-state humidifying operation that is performed in the capping operation; and a recording-state humidifying operation that is performed in the image recording operation. In the nonoperating-state humidifying operation, as illustrated in FIG. 4A, humid air is supplied from the first supply opening portion 65 to the defined ejection space S1, and air in the defined ejection space S1 is discharged from the discharge opening portion 85. The ejection space S1 is filled with water or moisture, thereby further suppressing drying of the ejection openings 108. The nonoperating-state humidifying operation is performed in a specific period in the capping operation. In the recording-state humidifying operation, as illustrated in FIG. 4B, humid air is supplied from the second supply opening portion 68 to the ejection space S1 open to or communicating with the outside space S2. This humid air is supplied to the ejection openings 108, thereby suppressing the drying of the ejection openings 108.

There will be next explained the head 1 with reference to FIGS. 2A-6. In FIG. 3A, pressure chambers 110 and the ejection openings 108 are illustrated by solid lines for easier understanding purposes though these elements are located under the actuator units 21 and thus should be illustrated by broken lines.

Figure 2A:
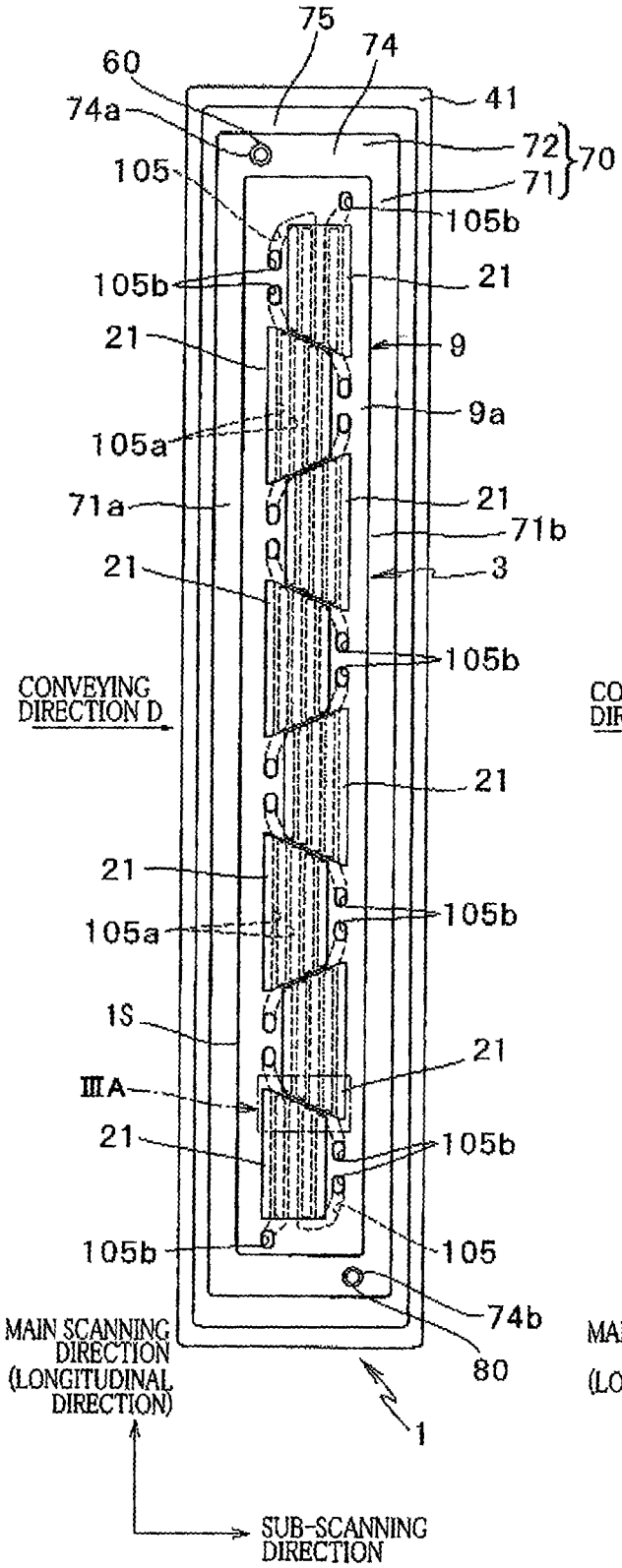
FIG. 2A is a top view of a head in the printer.
Figure 2B:
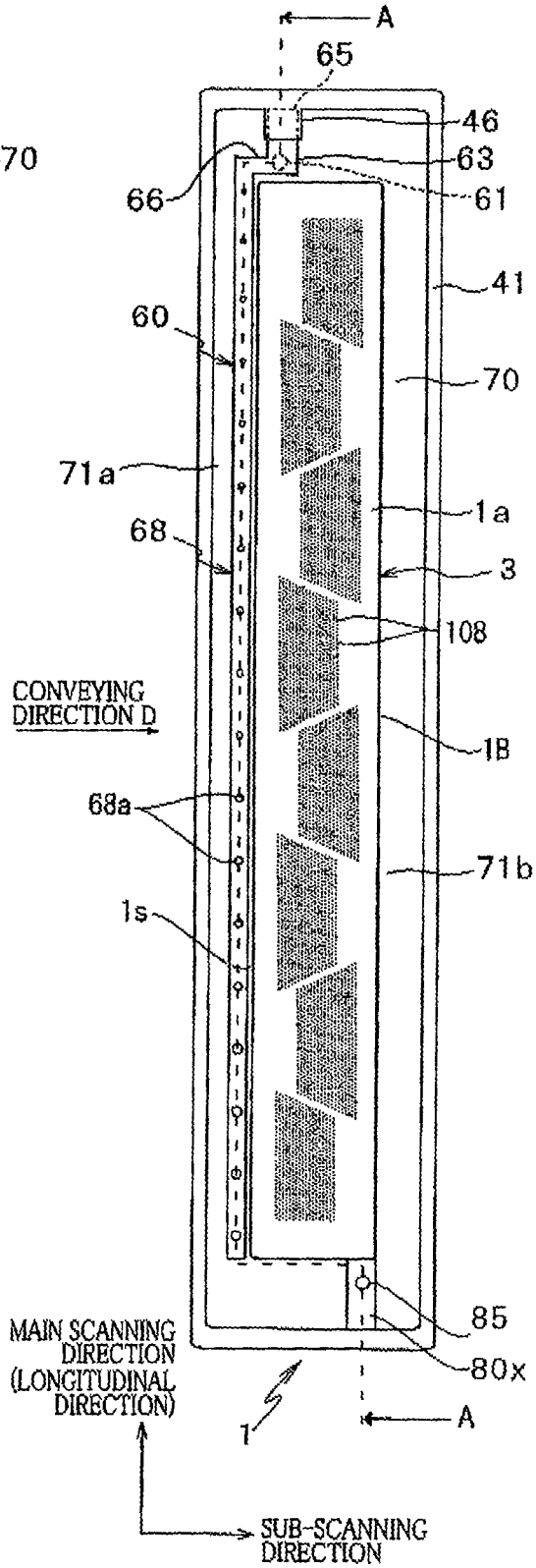
FIG. 2B is a bottom view of the head.

As illustrated in FIG. 2A, the head main body 3 is a stacked body including the channel unit 9 and the eight actuator units 21 fixed to an upper face 9*a* of the channel unit 9. The pressure chambers 110 are open in the upper face 9*a*. As illustrated in FIG. 3C, the actuator units 21 seal these openings so as to act as side walls of the respective pressure chambers 110.

Figure 3B:
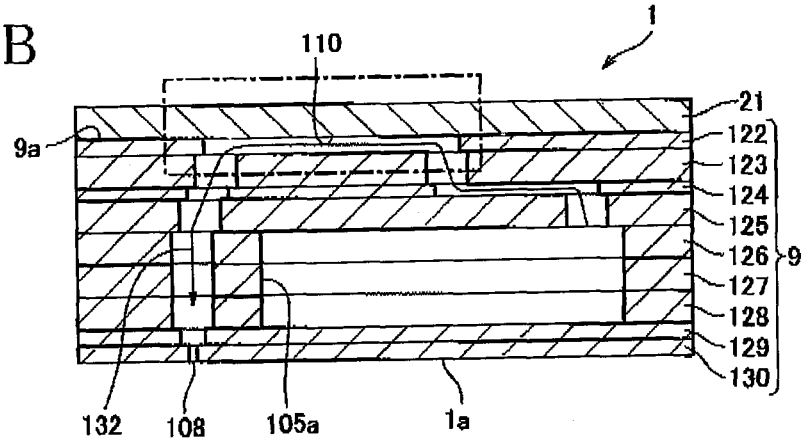
FIG. 3B is a partial cross-sectional view taken along line IIIB-IIIB in FIG. 3A.
Figure 3C:
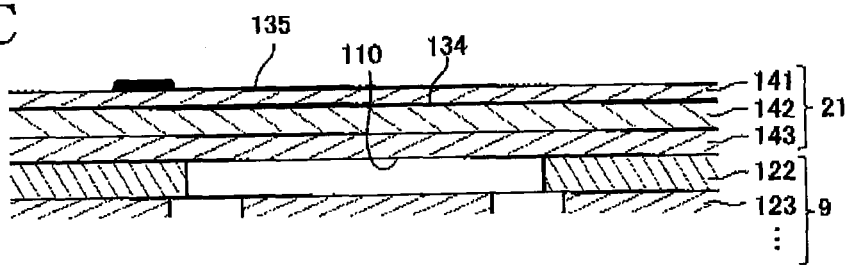
FIG. 3C is an enlarged view illustrating an area enclosed by one-dot chain line in FIG. 3B.

As illustrated in FIG. 3B, the channel unit 9 is a stacked body constituted by nine stainless plates 122-130 stacked on one another. Ink channels are formed in the channel unit 9. These ink channels include: manifold channels 105 each having, at its one end, a corresponding one of the ink supply openings 105*b* formed in the upper face 9*a*; sub-manifold channels 105*a* each branched from a corresponding one of the manifold channels 105; and individual ink channels each extending from an outlet of a corresponding one of the sub-manifold channels 105*a* to a corresponding one of the ejection openings 108 formed in a lower face of the channel unit 9 via a corresponding one of the pressure chambers 110.

There will be next explained the actuator units 21. As illustrated in FIG. 2A, each of the eight actuator units 21 has a trapezoid shape in plan view, and these actuator units 21 are arranged along the main scanning direction so as not to overlap the ink supply openings 105*b*.

As illustrated in FIG. 3C, each of the actuator units 21 is constituted by three piezoelectric layers 141-143 each formed of a ceramic material of lead zirconate titanate (PZT) having ferroelectricity. A multiplicity of individual electrodes 135 are disposed on an upper face of the uppermost piezoelectric layer 141 that is polarized in its thickness direction. Portions of the piezoelectric layer 141 sandwiched between the individual electrodes 135 and the pressure chambers 110 act as individual unimorph actuators. When an electric field is applied between one of the individual electrodes 135 and a common electrode 134 in the polarization direction, the corresponding actuator portion of the piezoelectric layer 141 is deformed so as to project toward the corresponding pressure chamber 110 (noted that this deformation is called a unimorph deformation). This deformation pressurizes the ink in the pressure chamber 110, causing an ink droplet to be ejected from the corresponding ejection opening 108. Here, the common electrode 134 is always at ground potential. Also, drive signals are selectively supplied to the individual electrodes 135.

The present embodiment adopts what is called a fill-before-fire method for the ink ejection. Each individual electrode 135 is set at a predetermined electric potential in advance, keeping the unimorph deformation of the actuator. When the drive signal is supplied, the electric potential of the individual electrode 135 is temporarily made equal to that of the common electrode 134, and, after a predetermined length of time, returned to the predetermined electric potential. At the timing when the individual electrode 135 is made equal in electric potential to the common electrode 134, the actuator terminates the unimorph deformation, so that the ink is sucked to the pressure chamber 110. Then, at the timing when the electric potential is returned to the predetermined electric potential, the actuator causes the unimorph deformation again, which ejects the ink droplet from the ejection opening 108.

As illustrated in FIGS. 2A, 2B, 5, and 6, a side cover 70 is fixed to the head 1. The side cover 70 is a resin member enclosing the entire perimeter of the head main body 3. The side cover 70 expands on side faces of the channel unit 9 and the reservoir unit. The side cover 70 is constituted by long portions 71 extending in the main scanning direction and short portions 72 extending in the sub-scanning direction. The side cover 70 includes a fixed portion 74 and a brim portion 75. The fixed portion 74 has a mount surface expanding in a direction perpendicular to the ejection face 1*a* and is fixed to side faces of the head main body 3. The brim portion 75 is a projecting portion horizontally expanding outward and connected to a lower end of the fixed portion 74.

The fixed portion 74 has an inlet portion and an outlet portion through which the humid air is supplied and discharged. The inlet portion is provided in an upper one of the short portions 72 in FIG. 2A and located at an upstream end portion of the fixed portion 74 in the conveying direction D. The humid air flows from the inlet portion into the ejection space S1. The inlet portion is constituted by a through hole 74*a* extending through the fixed portion 74 in an up and down direction and the supply pipe 60 (which will be described below) fitted in the through hole 74*a*. The outlet portion is provided in a lower one of the short portions 72 in FIG. 2A and located at a downstream end portion in the conveying direction D. The air in the ejection space S1 is discharged from the outlet portion. The outlet portion is constituted by a through hole 74*b* extending through the fixed portion 74 in the up and down direction and a discharge pipe 80 fitted in the through hole 74*b*. The through holes 74*a*, 74*b* are arranged so as to be symmetrical to each other about a center of the ejection face 1*a*. As a result, the humid air flows so as to expand to the entire area of the ejection face 1*a*.

Figure 5:
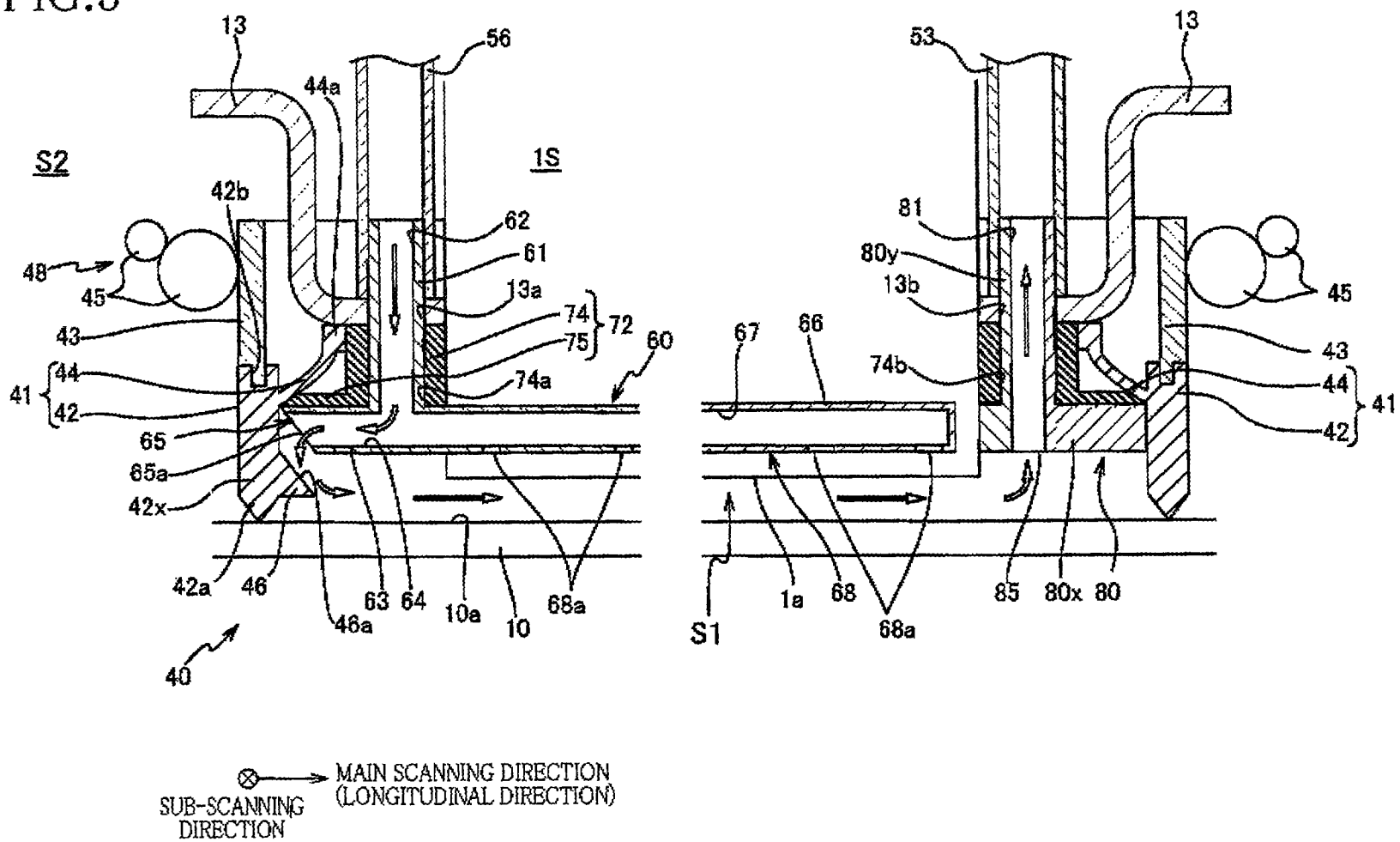
FIG. 5 is a partial cross-sectional view taken along line A-A in FIG. 2B, illustrating a nonoperating-state humidifying operation.
Figure 6:
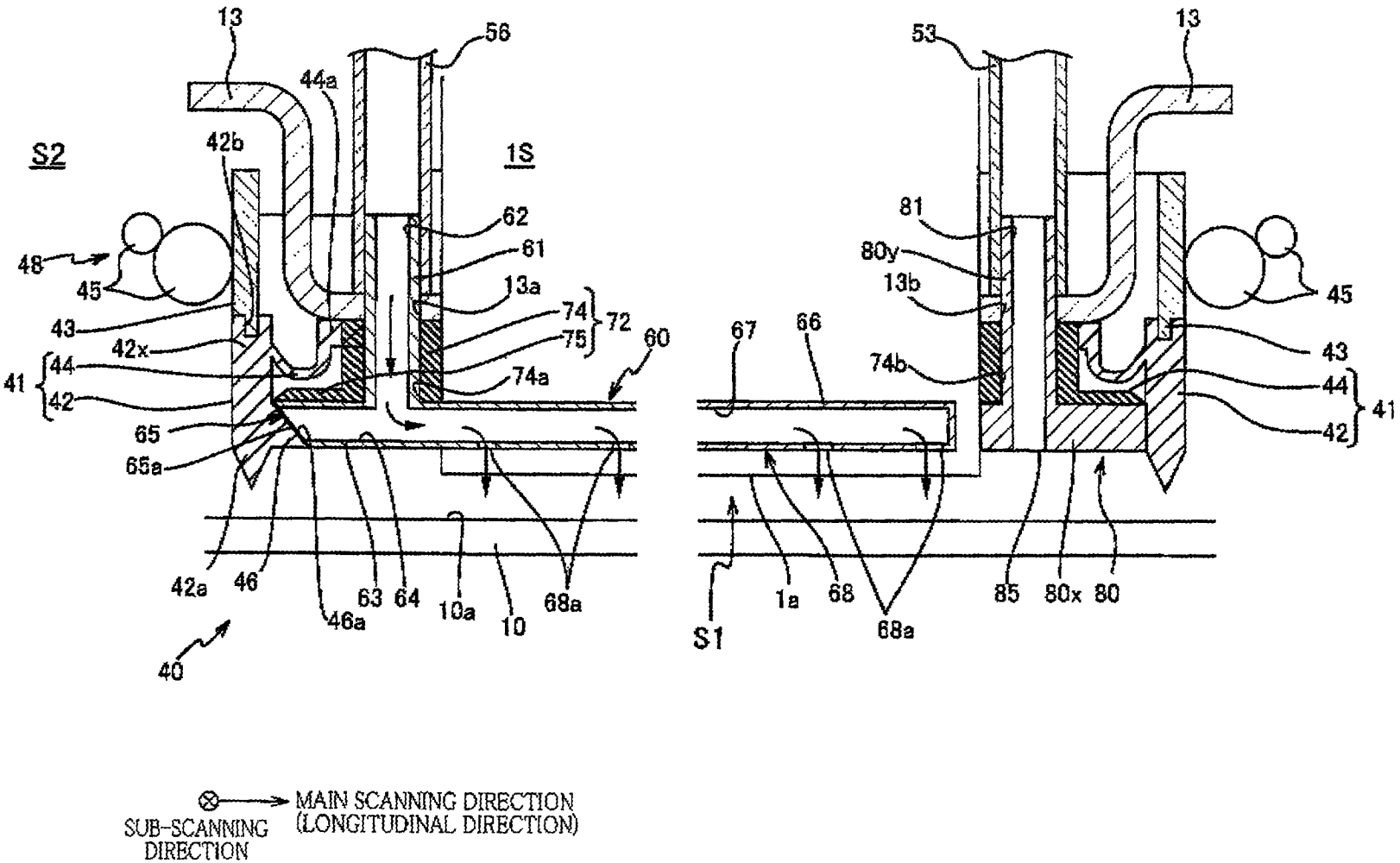
FIG. 6 is a partial cross-sectional view taken along line A-A in FIG. 2B, illustrating a recording-state humidifying operation.

There will be next explained structures of the head holder 13 and the cap mechanism 40 with reference to FIGS. 4-6.

The head holder 13 is a rigid-body frame formed of metal, for example, and supports the side faces of the head main body 3 in its entire perimeter. The separator 41 of the cap mechanism 40 is mounted on the head holder 13.

Here, contact portions of the head holder 13 and the head main body 3 are sealed with a sealant in their entire perimeter. Also, contact portions of the head holder 13 and the separator 41 are fixed to each other with an adhesive in their entire perimeter. The head holder 13 has through holes 13*a*, 13*b* formed respectively corresponding to the through holes 74*a*, 74*b* of the short portions 72. The supply pipe 60 and the discharge pipe 80 are respectively fitted in the through holes 13*a*, 13*b*.

The cap mechanism 40 includes: the separator 41; a cap elevating and lowering mechanism (a lip moving mechanism) 48 for elevating and lowering the separator 41; the facing member 10; and a facing-member elevating and lowering mechanism, not shown, for elevating and lowering the facing member 10. The separator 41 is elongated in the main scanning direction and can enclose the side cover 70 and the ejection space S1 (i.e., the ejection openings 108) with the facing member 10 and the ejection face 1*a*. As illustrated in FIGS. 5 and 6, the separator 41 includes a lip member 42 and a diaphragm 44.

The lip member 42 is formed of an elastic material such as rubber and encloses the head 1 in plan view. That is, the lip member 42 is provided outside the side cover 70. The lip member 42 includes: a base portion 42*x*; a projecting portion 42*a* projecting from a lower face of the base portion 42*x*; and a movable member 43. The projecting portion 42*a* has a triangle shape in its cross section, and its distal end can contact the facing member 10. Formed in an upper face of the base portion 42*x* is a recessed portion 42*b* in which a lower end of the movable member 43 is fitted. The movable member 43 encloses the head 1 and is formed of a rigid material such as stainless steel.

Also, a projection 46 projecting inward in the longitudinal direction is provided on an inner face of the base portion 42*x* which extends in the sub-scanning direction (i.e., a widthwise direction). As illustrated in FIG. 5, the projection 46 has a triangle shape in its cross section, and an upper face of the projection 46 is inclined downward in an inward direction. This inclined face, namely, a closing surface 46*a* can contact the first supply opening portion 65 (which will be described below) to close a supply opening 65*a*.

The diaphragm 44 is a thin-layer member formed of a flexible material such as rubber and enclosing the head 1 in plan view. The diaphragm 44 is designed such that its outer circumferential end is integrally connected to the lip member 42, and its inner circumferential end portion is formed as a close-contact portion 44*a*. An outer side face of the close-contact portion 44*a* is a base portion of the diaphragm 44. Also, an inner side face of the close-contact portion 44*a* is fixed to the fixed portion 74 of the side cover 70, and an upper face of the close-contact portion 44*a* is fixed to a lower face of the head holder 13.

The cap elevating and lowering mechanism 48 includes a plurality of gears 45 and an up/down motor, not shown. One of the gears 45 is engaged with the movable member 43. When the controller 100 drives the up/down motor, the gears 45 are rotated to elevate or lower the movable member 43. As a result, a position of the distal end of the projecting portion 42*a* relative to the ejection face 1*a* is changed vertically.

With the upward and downward movement of the movable member 43, the distal end of the lip member 42 (i.e., the projecting portion 42*a*) is selectively located at one of a contact position, illustrated in FIGS. 4A and 5, at which the distal end of the lip member 42 is held in contact with an upper face 10*a* of the facing member 10, and a distant position, illustrated in FIGS. 4B and 6, at which the distal end of the lip member 42 is spaced apart from the upper face 10*a*. At the contact position, the distal end 42*d* of the lip member 42 can contact the upper face 10*a* of the facing member 10 located at a first position which will be described below. When the lip member 42 is brought into contact with the upper face 10*a* of the facing member 10 located at the first position, the ejection space S1 is switched to the closed state in which the ejection space S1 is enclosed with the ejection face 1*a*, the facing member 10, and the separator 41 so as to be substantially isolated from the outside space S2. At the distant position, the ejection space S1 is in an open state or an uncapped state in which the ejection space S1 is open to or communicates with the outside space S2. It is noted that at the distant position the distal end of the lip member 42 located slightly lower than the ejection face 1*a* in such a degree that does not inhibits the conveyance of the sheet P.

The facing member 10 is a glass plate having a rectangular planar shape which is one size larger than the lip member 42 in plan view. The upper face 10*a* has higher hydrophilicity than a surface of the lip member 42. As a result, the ink remaining on the lip member 42 tends to move toward the upper face 10*a*.

Figure 7A:
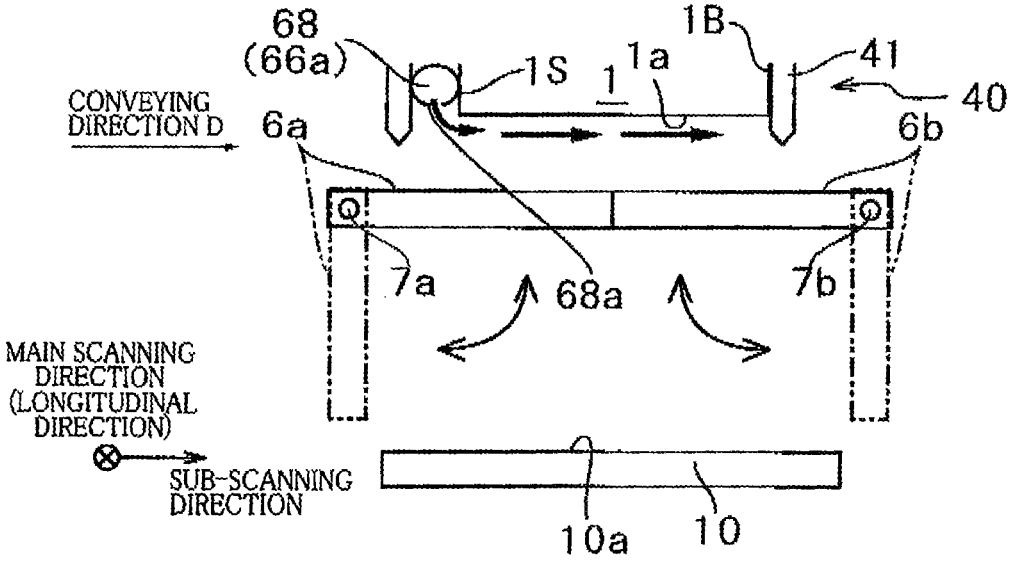
FIGS. 7A and 7B are views each illustrating a situation for explaining operations of a cap mechanism, a supporting mechanism, and a facing member.
Figure 7B:
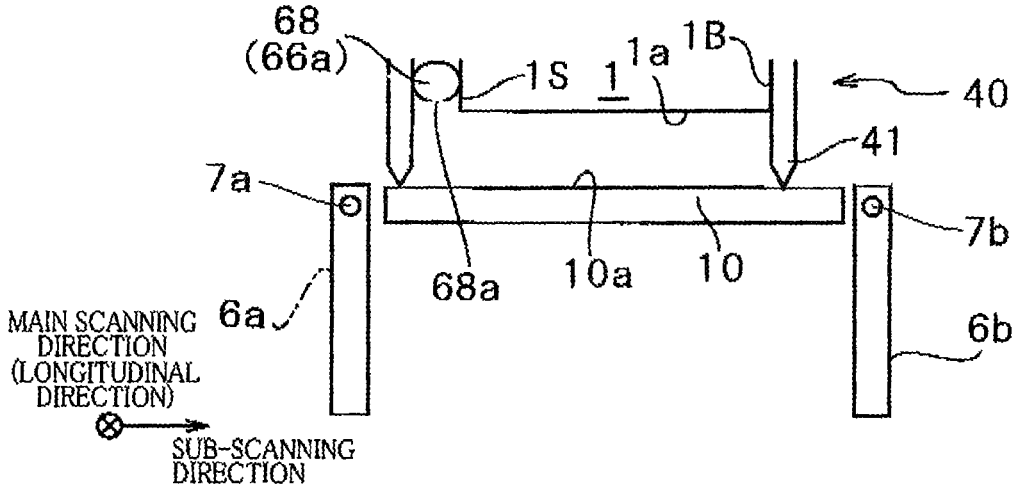

The facing-member elevating and lowering mechanism elevates and lowers the facing member 10 between the first position and a second position. As illustrated in FIG. 7B, the first position is a position at which the facing member 10 is the nearest to the ejection face 1*a* among positions of the facing member 10. This first position corresponds to the contact position of the lip member 42 and is associated with the capping operation. Here, in the present embodiment, a distance between the upper face 10*a* and the ejection face 1*a* is equal to a distance between the support face of the platens 6*a*, 6*b* and the ejection face 1*a* during the image recording. As illustrated in FIG. 7A, the second position is a position at which the distance between the upper face 10*a* and the ejection face 1*a* is greater than that at the first position. The facing member 10 is located at this second position during the image recording.

There will be next explained a structure of the humidifying mechanism 50. As described above, the humidifying mechanism 50 includes the supply pipe 60, the discharge pipe 80, the tubes 53-56, the tank 57, the pump 58, and the three-way valve 59.

The humid-air supplying portion including the supply pipe 60 and the discharge pipe 80 will be explained first. The supply pipe 60 partly constitutes the inlet portion for the humid air. The supply pipe 60 includes a first supply pipe (i.e., a first air channel) 61, a second supply pipe (i.e., a second air channel) 63, and a third supply pipe (i.e., a third air channel) 66 which communicate with one another. After flowing into the first supply pipe 61, the humid air is supplied to the ejection space S1 through the second supply pipe 63 when the ejection space S1 is in the closed state, and supplied to the ejection space S1 through the third supply pipe 66 when the ejection space S1 is in the open state.

The first supply pipe 61 extends in the up and down direction along the side face of the head 1. The first supply pipe 61 extends not only through the through hole 74*a* of the fixed portion 74 but also through the through hole 13*a* of the head holder 13, and the tube 56 is connected to an exposed distal end portion of the first supply pipe 61. There is a small clearance between the first supply pipe 61 and each of the through holes 13*a*, 74*a*, but this clearance is filled with a sealing material or other suitable materials. It is noted that the inside of the first supply pipe 61 is a first air channel 62 through which the humid air flows. This first air channel 62 is one example of an air channel to which the humid air is supplied from an outside.

The second supply pipe 63 extends in the longitudinal direction along a lower face of the fixed portion 74, and an upper face of the second supply pipe 63 is bonded to the lower face of the fixed portion 74. One end of the second supply pipe 63 is connected to a lower end of the first supply pipe 61, and the other end of the second supply pipe 63 faces an inner wall face of the lip member 42. The other end is the first supply opening portion 65. A second air channel 64 is formed in the second supply pipe 63. One end of the second air channel 64 is connected to the first air channel 62, and the other end of the second air channel 64 is open in an opening surface of the first supply opening portion 65. The opening in the other end is the supply opening 65*a*. It is noted that as illustrated in FIG. 5 the opening surface (the first supply opening portion 65) faces the closing surface 46*a* of the lip member 42 in the up and down direction. In the closed state, the opening surface is spaced apart from the closing surface 46*a*. In the open state, as illustrated in FIG. 6, the opening surface is held in contact with the closing surface 46*a* to close the supply opening 65*a*. The humid air is supplied from the supply opening 65*a* into the ejection space S1 being in the closed state.

The third supply pipe 66 has an L-shape in plan view, and its upper face is bonded to the lower face of the fixed portion 74. The third supply pipe 66 extends along the side face of the head 1, curves at a corner portion of the head 1, and extends in the longitudinal direction. One end of the third supply pipe 66 is connected to a connecting portion of the first supply pipe 61 and the second supply pipe 63, and the other end of the third supply pipe 66 is a closed portion. A portion of the third supply pipe 66 which corresponds to a long side of the L-shape is the second supply opening portion 68 whose lower face extends substantially along the entire length of the head 1, and this lower face has a plurality of supply openings 68*a* formed therein. Each of the supply openings 68*a* communicates with the first air channel 62 and the second air channel 64 via a third air channel 67 formed in the third supply pipe 66. The humid air is supplied from the supply openings 68*a* into the ejection space S1 being in the open state. It is noted that the portion corresponding to the long side of the L-shape is interposed between the upstream side face 1S of the head 1 and an upstream-side inner face of the lip member 42. Also, the third supply pipe 66 is located above the ejection face 1*a*, that is, the third supply pipe 66 is located at a position farther from the platens 6*a*, 6*b* than the ejection face 1*a* so as not to inhibit the conveyance of the sheet P.

A resistance to air in the third air channel 67 (i.e., a channel resistance to air in the third air channel 67) decreases from an upstream side toward a downstream side in a direction of flow of the humid air. In the present embodiment, as illustrated in FIG. 2B, in each adjacent two of the supply openings 68*a*, an opening area of a downstream one of the two supply openings 68*a* in the direction of the flow of the humid air is larger than that of an upstream one of the two supply openings 68*a* in the direction of the flow of the humid air. As a result, a substantially equal amount of humid air is discharged from each of the supply openings 68*a*. As a modification, the third air channel 67 may be formed such that its cross-sectional area increases from the upstream side toward the downstream side in the direction of the flow of the humid air.

Also, a cross-sectional area of the second air channel 64 is larger than that of the third air channel 67. As a result, when the ejection space S1 is in the closed state, the humid air supplied from the first air channel 62 flows mainly through the second air channel 64 having the lower channel resistance and then enters into the ejection space S1 through the supply opening 65*a*. That is, when the ejection space S1 is in the closed state, an amount of the humid air supplied from the first air channel 62 to the second air channel 64 is greater than that of the humid air supplied from the first air channel 62 to the third air channel 67, so that an amount of the humid air supplied to the first supply opening portion 65 is greater than that of the humid air supplied to the second supply opening portion 68.

As illustrated in FIG. 5, the discharge pipe 80 partly constitutes the outlet portion for the humid air. The discharge pipe 80 includes a basal end portion 80*x* having a rectangular parallelepiped shape and a cylindrical portion 80*y* having a circular cylindrical shape. The cylindrical portion 80*y* projects from an upper face of the basal end portion 80*x* and extends through the through hole 13*b* of the head holder 13 and the through hole 74*b* of the fixed portion 74, and the tube 53 is connected to an exposed distal end portion of the cylindrical portion 80*y*. There is a small clearance between the discharge pipe 80 and the through holes 13*b*, 74*b*, but this clearance is filled with a sealing material or other suitable materials. It is noted that an air discharge channel 81 extends through the basal end portion 80*x* and the cylindrical portion 80*y* in the up and down direction, and an opening portion of the air discharge channel 81 near the basal end portion 80*x* is the discharge opening portion 85.

The humid-air producing portion including the tank 57 and the pump 58 will be explained next. The tubes 53-56 mainly form a circulation path between the production source of the humid air (i.e., the tank 57) and the humid-air supplying portion. As illustrated in FIG. 4, one end of the tube 53 is connected to the discharge pipe 80, and the other end of the tube 53 is connected to the three-way valve 59. One end of the tube 54 is connected to the three-way valve 59, and the other end of the tube 54 is connected to the tank 57. The pump 58 is provided on the tube 54 between the three-way valve 59 and the tank 57. One end of the tube 55 communicates with ambient air, the other end of the tube 55 is connected to the three-way valve 59. The tube 54 can communicate with the tube 53 or the tube 55 via the three-way valve 59. One end of the tube 56 is connected to the tank 57, and the other end of the tube 56 is connected to the supply pipe 60.

A lower space of the tank 57 stores water for humidification, and an upper space of the tank 57 stores air humidified by the water. The tube 54 communicates with the lower space of the tank 57 (i.e., beneath a water surface), and the tube 56 communicates with the upper space of the tank 57. It is noted that a check valve, not shown, is attached to the tube 54 near the tank 57 to prevent the water from leaking from the tank 57. Also, when an amount of the water in the tank 57 becomes small, the tank 57 is replenished with water from a water replenishing tank, not shown.

Under the control of the controller 100, the three-way valve 59 switches connection of the tube 54 selectively to one of the tubes 53 and 55. Specifically, in the nonoperating-state humidifying operation, as illustrated in FIG. 4A, the three-way valve 59 establishes the connection between the tube 54 and the tube 53. In the recording-state humidifying operation, as illustrated in FIG. 4B, the three-way valve 59 establishes the connection between the tube 54 and the tube 55.

There will be next explained a series of the capping operation and the nonoperating-state humidifying operation in the printer 101. When the image recording operation is not performed, the printer 101 performs the humidifying operation in addition to the capping operation.

Upon the capping operation, a path for the humid air is formed in the longitudinal direction in the separator 41. Under the control of the controller 100, as illustrated in FIG. 7B, the platens 6*a*, 6*b* are moved to the open position, the facing member 10 is moved to the first position, and the lip member 42 is moved to the contact position. The separator 41 defines the ejection space S1 such that the ejection space S1 is substantially isolated from the outside space S2. In this closed state, as illustrated in FIG. 5, the closing surface 46*a* of the lip member 42 is spaced apart from the first supply opening portion 65, so that the supply opening 65*a* of the second supply pipe 63 is open.

Here, in a case where the closed state, i.e., the capping state, is continued, degrees of drying of the ejection openings 108 may vary in the longitudinal direction of the ejection space S1. This is caused mainly by residual ink on an inner wall of the separator 41 and past use of the ejection openings 108.

In a case where the printer 101 is used for a relatively long time, the inner wall of the separator 41 may be soiled with ink mist and ink itself. When dried, such residual ink acts as a drying agent or a water absorber, resulting in further drying in the ejection space S1 being in the closed state. In this case, since a part of the ejection openings 108 which is located at each end portion in the longitudinal direction is surrounded by the separator 41 from three sides, these ejection openings 108 are affected by the inner wall of the separator 41 more than a part of the ejection openings 108 which is located at a central portion in the longitudinal direction and which is surrounded by the separator 41 from two sides. A difference in the drying degree between the central portion and the end portions increases with elapse of time, resulting in a recognizable difference in recording quality.

The present embodiment employs what is called a side registration type to convey the sheets P through the same path in the same orientation. Thus, one edge of the sheet P in a direction perpendicular to the conveying direction D is limited or restrained so as to be conveyed in the predetermined position (noted that the other edge of the sheet P in the direction perpendicular to the conveying direction D is not limited). When a small size of the sheet P is being conveyed, ejection openings 108 located outside the other edge of the sheet P continue to be exposed to air, so that these ejection openings 108 dry in the image recording. Thus, at completion of a print job, newness of the ink in the ejection openings 108 is different depending upon positions.

Accordingly, a difference in a positional relationship between the inner wall of the separator 41 and the ejection openings 108 causes the ejection openings 108 to dry more speedily at the opposite end portions than at the central portion in the longitudinal direction. Furthermore, since the newness of the ink is different depending upon positions, the ejection openings 108 at the non-limited side of the sheet P are dried in advance when compared with those at the limited side of the sheet P. These effects are on the ejection space in the closed state. At the non-limited side, as a result, the ink dries speedily, so that deterioration of the recording quality becomes recognizable early.

In order to solve this problem, in the present embodiment, the ejection openings 108 are interposed between the first supply opening portion 65 and the discharge opening portion 85 in the longitudinal direction. In particular, the first supply opening portion 65 is disposed on the non-limited side. Thus, the non-limited side is humidified more than the limited side in the ejection space S1 in the closed state. Also, it is possible to suppress unevenness in an entire image recorded on the sheet P. The nonoperating-state humidifying operation will be specifically explained next.

When the nonoperating-state humidifying operation is performed, the three-way valve 59 establishes the communication between the tube 54 and the tube 53 and the pump 58 is driven under the control of the controller 100. As illustrated in FIGS. 4A and 5, air flows in a direction indicated by white arrows. The humid air in the upper space of the tank 57 is supplied to the first air channel 62 of the supply pipe 60. In this operation, the supplied humid air flows mainly to the second air channel 64 due to the difference in the channel resistance to the air. The humid air then flows into the ejection space S1 from the supply opening 65*a* of the first supply opening portion 65. The air in the ejection space S1 flows in the longitudinal direction toward the discharge opening portion 85 while replaced with the humid air. Also, the air in the ejection space S1 is sucked by the pump 58 and flows from the discharge opening portion 85 toward the tank 57. The air is humidified in the lower space of the tank 57 and moves to the upper space. The produced humid air is supplied to the ejection space S1 while the pump 58 is being driven. The series of the capping operation and the nonoperating-state humidifying operation have been explained.

There will be next explained a series of an uncapping operation (i.e., release of the capping) and the recording-state humidifying operation in the printer 101.

When the uncapping operation is performed, as illustrated in FIG. 7A, the controller 100 controls the facing member 10 to be moved to the second position, controls the lip member 42 to be moved to the distant position, and controls the platens 6*a*, 6*b* to be moved to the support-face forming position. As a result, the ejection space S1 becomes the open state not defined by the separator 41 and open to the outside space S2. In this open state, as illustrated in FIG. 6, the closing surface 46*a* of the lip member 42 is held in contact with the first supply opening portion 65 to close the supply opening 65*a*.

When the recording-state humidifying operation is performed in the image recording operation, the three-way valve 59 establishes the communication between the tube 54 and the tube 55 and the pump 58 is driven under the control of the controller 100. As illustrated in FIG. 4B and FIG. 6, air flows in a direction indicated by black arrows. The humid air in the upper space of the tank 57 is supplied to the first air channel 62. Since the supply opening 65*a* is closed in this state, the humid air flows to the third air channel 67. The humid air is then delivered into the ejection space S1 from the plurality of supply openings 68*a* of the second supply opening portion 68 and supplied to the ejection openings 108. Movement of the humid air from the supply openings 68*a* to the ejection openings 108 is caused by the conveyance of the sheet P in this direction. As a result, it is possible to suppress the drying of the ejection openings 108 also in the uncapping state, thereby reducing consumption of the ink.

Also, as described above, in each adjacent two of the supply openings 68*a*, the opening area of the downstream one of the two supply openings 68*a* in the direction of the flow of the humid air is larger than that of the upstream one of the two supply openings 68*a* in the direction of the flow of the humid air. That is, the channel resistance to the air in the third air channel 67 decreases from the upstream side toward the downstream side in the direction of the flow of the humid air. As a result, amounts of the humid air supplied to the supply openings 68*a* are generally equal to one another. Also, while the air flow in the conveying direction D is produced in the ejection space S1, the second supply opening portion 68 is disposed along the upstream side face 1S of the head 1, making it possible to efficiently supply the humid air to the ejection openings 108.

Also, the second supply opening portion 68 is disposed downstream of an upstream-side inner face of the lip member 42 in the conveying direction D. Thus, the humid air can be reliably supplied into the ejection space S1. Furthermore, as described above, the distal end of the lip member 42 at the distant position is located slightly lower than the ejection face 1*a*. Thus, the humid air supplied into the ejection space S1 from the supply openings 68*a* of the second supply opening portion 68 tends to remain in the ejection space S1. As a result, the humid air is efficiently supplied to the ejection openings 108. The series of the uncapping operation and the recording-state humidifying operation have been explained.

In the present embodiment described above, the plurality of ejection openings 108 are interposed between the first supply opening portion 65 and the discharge opening portion 85 in the longitudinal direction when viewed from the direction perpendicular to the ejection face 1*a*. As a result, in the nonoperating-state humidifying operation, opposite side areas of the ejection space S1 in the longitudinal direction are reliably contained in a flowing path of the humid air. This makes it possible to reliably suppress the drying of the ejection openings 108 located on the opposite end portions in the longitudinal direction.

Also, the projection 46 of the lip member 42 as one example of a supply-opening switching mechanism can easily switch a destination of the supply of the humid air with the upward and downward movement of the lip member 42. The supply-opening switching mechanism is configured to change resistance of a channel that fluidically couples the first air channel 62 and the first supply opening portion 65 with each other. Specifically, when the ejection space S1 is in the open state, the closing surface 46*a* of the projection 46 is held in contact with the first supply opening portion 65 to close the first supply opening portion 65, resulting in relatively high resistance of the channel fluidically coupling the first air channel 62 and the first supply opening portion 65. As a result, the amount of the humid air supplied from the first air channel 62 to the third air channel 67 is greater than that of the humid air supplied from the first air channel 62 to the second air channel 64, so that the amount of the humid air supplied to the second supply opening portion 68 is greater than that of the humid air supplied to the first supply opening portion 65. When the ejection space S1 is in the closed state, on the other hand, the closing surface 46*a* is spaced apart from the first supply opening portion 65 to open the first supply opening portion 65, resulting in relatively low resistance of the channel fluidically coupling the first air channel 62 and the first supply opening portion 65. As a result, the amount of the humid air supplied from the first air channel 62 to the second air channel 64 is greater than that of the humid air supplied from the first air channel 62 to the third air channel 67, so that the amount of the humid air supplied to the first supply opening portion 65 is greater than that of the humid air supplied to the second supply opening portion 68. In view of the above, the supply-opening switching mechanism can change the resistance to switch between the state in which the amount of the humid air supplied to the second supply opening portion 68 is greater than that of the humid air supplied to the first supply opening portion 65 and the state in which the amount of the humid air supplied to the first supply opening portion 65 is greater than that of the humid air supplied to the second supply opening portion 68.

Second Embodiment

Figure 8A:
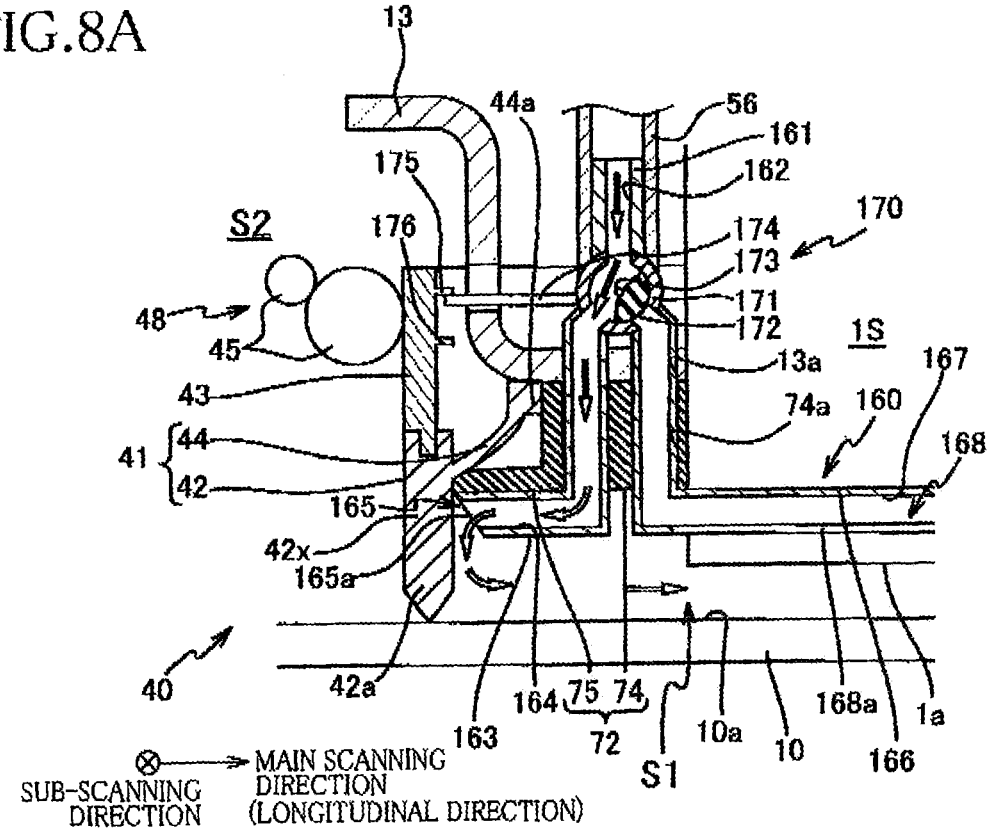
FIGS. 8A and 8B are partial cross-sectional views respectively corresponding to FIGS. 5 and 6 and each illustrating a vicinity of a first supply opening portion in a second embodiment.
Figure 8B:
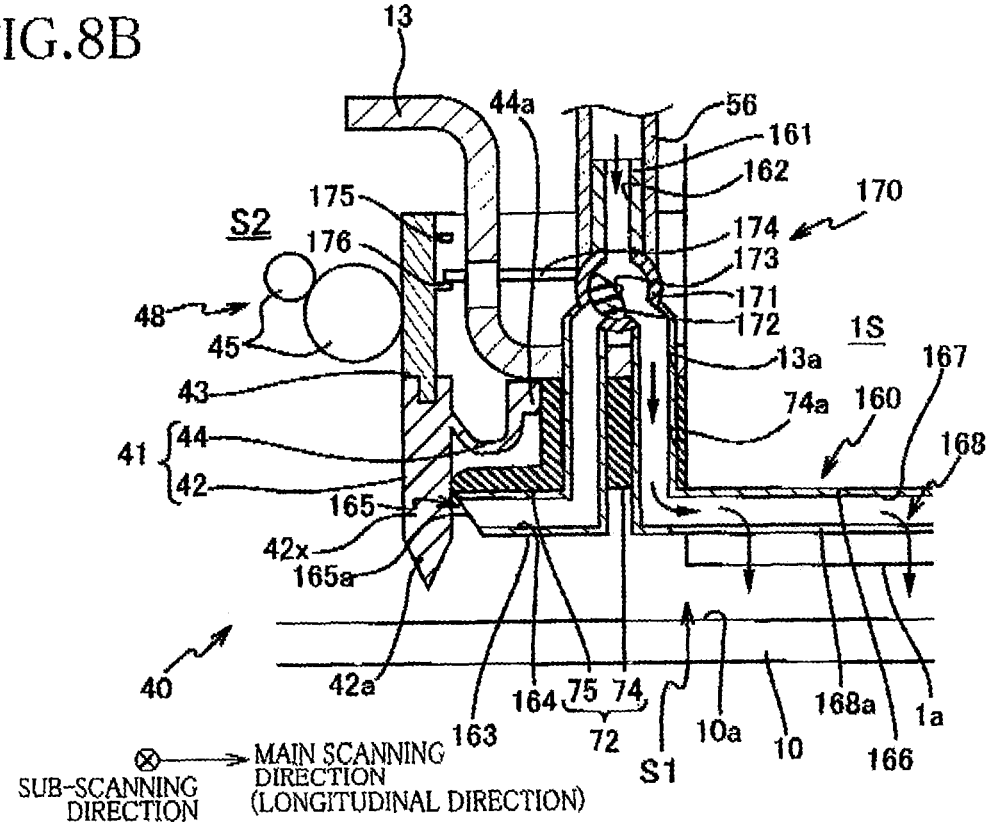

There will be next explained a second embodiment of the present invention with reference to FIGS. 8A and 8B. The second embodiment differs from the first embodiment in a structure of the supply-opening switching mechanism. In the second embodiment, the supply-opening switching mechanism includes a three-way valve 170, and constructions of supply pipes differ from those in the first embodiment. Also, the lip member 42 does not have the projection 46. It is noted that the same reference numerals as used in the first embodiment are used to designate the corresponding elements of this second embodiment, and an explanation of which is dispensed with.

In the present embodiment, a supply pipe 160 partly constituting the humidifying mechanism 50 includes a first supply pipe 161, a second supply pipe 163, a third supply pipe 166, and the three-way valve 170 for switching a destination of the supply of the humid air. The first supply pipe 161 is generally similar in construction to the first supply pipe 61 except that one end of the first supply pipe 161 is connected to the three-way valve 170. A first air channel 162 is formed in the first supply pipe 161 to which the humid air is supplied from the tank 57. The second supply pipe 163 is generally similar in construction to the second supply pipe 63 except that one end of the second supply pipe 163 is connected to the three-way valve 170. The other end of the second supply pipe 163 is a first supply opening portion 165 in which a supply opening 165*a* is open. A second air channel 164 is formed in the second supply pipe 163. The three-way valve 170 permits the second air channel 164 to communicate with the first air channel 162 in the closed state. The third supply pipe 166 is generally similar in construction to the third supply pipe 66 except that one end of the third supply pipe 166 is connected to the three-way valve 170. A third air channel 167 is formed in the third supply pipe 166. The three-way valve 170 permits the third air channel 167 to communicate with the first air channel 162 in the open state. The third supply pipe 166 has a second supply opening portion 168. While the supply pipes 163, 166 are provided so as to be branched from the three-way valve 170, arrangement of these supply pipes 163, 166 to the side cover 70 may be any arrangement. It is noted that the first air channel 162 is also one example of the air channel to which the humid air is supplied from the outside.

The ejection openings 108 are interposed between the supply opening 165*a* and the discharge opening portion 85 in the longitudinal direction. Also, the third supply pipe 166 has an extending portion that extends in the longitudinal direction along the upstream side face of the head 1. The second supply opening portion 168 includes a plurality of slit-shaped openings 168*a* formed in a lower face of the extending portion. In each adjacent two of the openings 168*a*, a width, in the sub-scanning direction, of the downstream one of the two openings 168*a* in the direction of the flow of the humid air is larger than that of the upstream one of the two supply openings 68*a* in the direction of the flow of the humid air. A channel resistance to air in the third supply pipe 166 decreases from an upstream side toward a downstream side in the direction of the flow of the humid air. As a result, generally equal amounts of the humid air is supplied to the respective supply openings 108.

The three-way valve 170 is designed to switch connection of the first air channel 162 selectively to one of the second air channel 164 and the third air channel 167. The three-way valve 170 includes a valve housing 171, a valve member 172 as one example of a closing member, a pivot shaft 173, a lever 174, an upper rib 175, and a lower rib 176. The valve housing 171 has a cylindrical shape and includes three ports respectively connected to the air channels 162, 164, 167.

The valve member 172 is pivotably disposed in the valve housing 171. The valve member 172 is pivoted to seal or close one of the ports respectively connected to the second air channel 164 and the third air channel 167. The valve member 172 is connected to the shaft 173 in the valve housing 171, and one end of the lever 174 is connected to the shaft 173 outside the valve housing 171. The valve member 172, the shaft 173, and the lever 174 are pivoted integrally with one another. The lever 174 is disposed substantially horizontally, and the other end thereof faces an inner wall of the movable member 43. The two ribs 175, 176 projects from the inner wall of the movable member 43 with a predetermined space interposed therebetween. The other end of the lever 174 is interposed between these ribs 175, 176 in the up and down direction. The two ribs 175, 176 and the other end of the lever 174 overlap each other in the up and down direction, i.e., in a vertical direction. With the upward and downward movement of the lip member 42, one of the two ribs 175, 176 is brought into contact with the other end of the lever 174.

There will be next explained operations of the supply-opening switching mechanism. In the present embodiment, the upward and downward movement of the movable member 43 causes displacement (i.e., the pivotal movement) of the valve member 172 via the lever 174. The upward and downward movement of the movable member 43 corresponds to the capping operation and the uncapping operation of the cap mechanism 40.

When the capping operation is performed, the lip member 42 is moved to the contact position, and the movable member 43 is moved to its lower end position. In the middle of the downward movement of the movable member 43, as illustrated in FIG. 8A, the upper rib 175 is brought into contact with the lever 174 to lower the lever 174. This displacement of the lever 174 causes the valve member 172 to seal the port connected to the third air channel 167. As a result, the first air channel 162 communicates with the second air channel 164. On the other hand, when the uncapping operation is performed, the lip member 42 is moved to the open position, and the movable member 43 is moved to its upper end position. In the middle of the upward movement of the movable member 43, as illustrated in FIG. 8B, the lower rib 176 is brought into contact with the lever 174 to elevate the lever 174. This displacement of the lever 174 causes the valve member 172 to seal the port connected to the second air channel 164. As a result, the first air channel 162 communicates with the third air channel 167.

In the nonoperating-state humidifying operation, the humid air flows in the longitudinal direction from the supply opening 165*a* toward the discharge opening portion 85. In the recording-state humidifying operation, the humid air is delivered from the slit-shaped openings 168*a* in the widthwise direction by the air flow produced by the conveyance of the sheet P. In the present embodiment, the three-way valve 170 partly constitutes the supply-opening switching mechanism. Also, the upper rib 175 and the lower rib 176 are one example of a channel switching portion of the three-way valve 170 and are mechanically coupled to the lip member 42 as described above.

The switching portion (i.e., the upper rib 175 and the lower rib 176) of the three-way valve 170 is mechanically connected to the movable member 43 in the above-described embodiment, but as a modification, the switching portion may be mechanically connected to the lip member 42 or the diaphragm 44 and may be mechanically connected to both of the lip member 42 and the diaphragm 44.

In the present embodiment described above, the three-way valve 170 can reliably switch the destination of the connection of the first air channel 162 between the second air channel 164 and the third air channel 167. Also, since this switching of the three-way valve 170 is performed by the upper rib 175 and the lower rib 176 mechanically connected to the movable member 43, the destination of the connection of the first air channel 162 can be easily switched in conjunction with the movement of the lip member 42 between the contact position and the distant position. That is, the supply-opening switching mechanism is configured to change: resistance of a channel that fluidically couples the first air channel 162 and the first supply opening portion 165 with each other; and resistance of a channel that fluidically couples the first air channel 162 and the second air channel 164.

Third Embodiment

There will be next explained a third embodiment of the present invention with reference to FIGS. 9A-10B. The third embodiment differs from the first embodiment in constructions of the supply-opening switching mechanism and the humidifying mechanism. A change in a positional relationship between the separator 41 and the side cover 70 switches a supply opening. A first supply opening portion 265 is formed in the closed state, and a second supply opening portion 268 and a third supply opening portion 269 are formed in the open state. The third supply opening portion 269 is similar in construction to the second supply opening portion 268. The third supply opening portion 269 extends along the side face of the head 1 on a downstream side thereof. Also, the lip member 42 does not have the projection 46. It is noted that the same reference numerals as used in the first embodiment are used to designate the corresponding elements of this third embodiment, and an explanation of which is dispensed with.

Figure 9A:
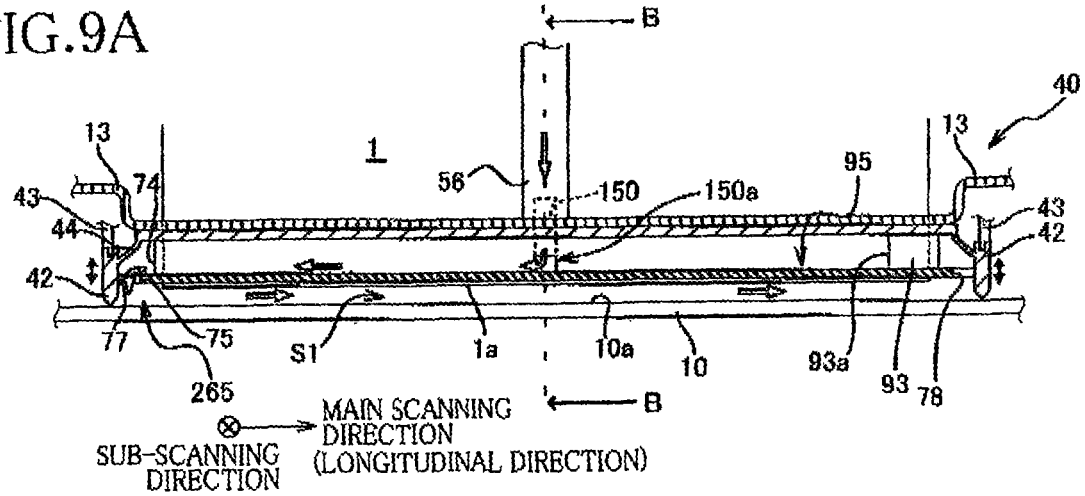
FIG. 9A is a schematic view illustrating a side cover and a cap mechanism in a third embodiment.
Figure 9B:
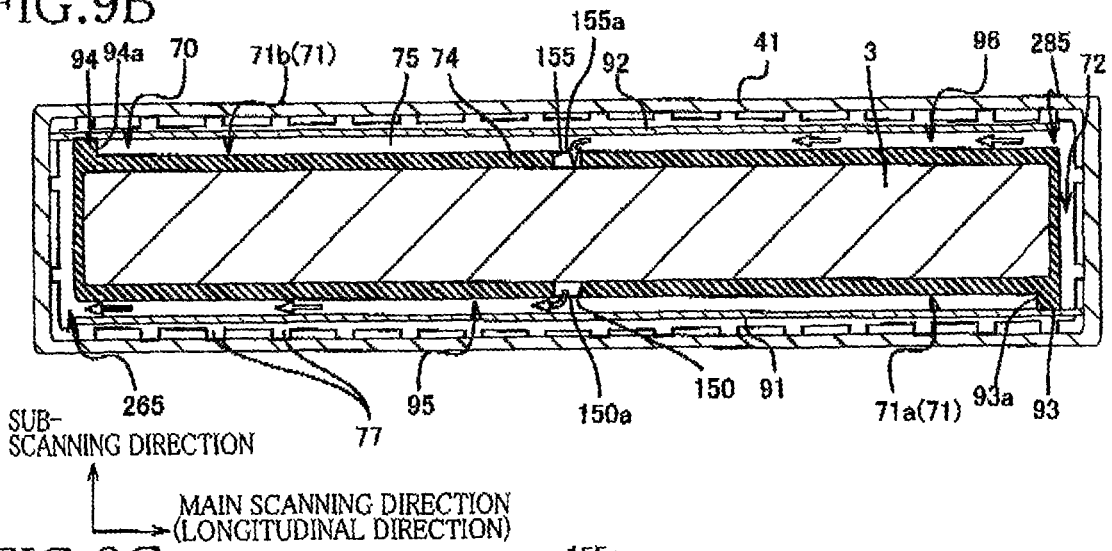
FIG. 9B is a plan view illustrating a head in a nonoperating-state humidifying operation.
Figure 10A:
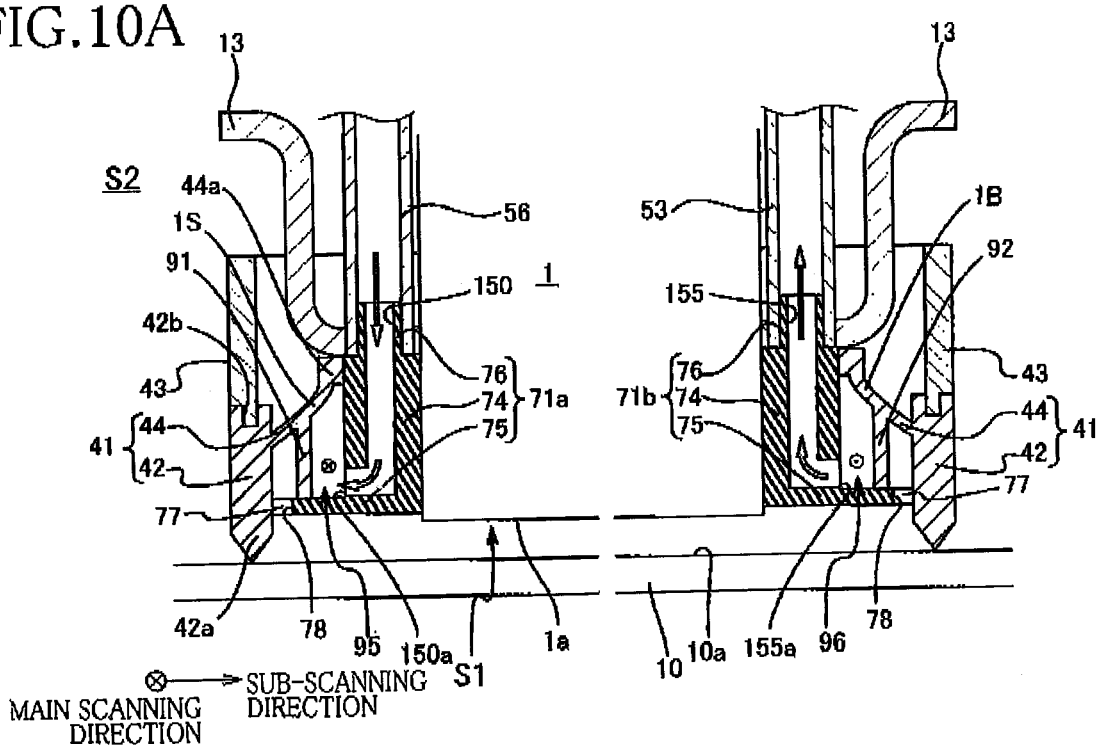
Figure 10B:
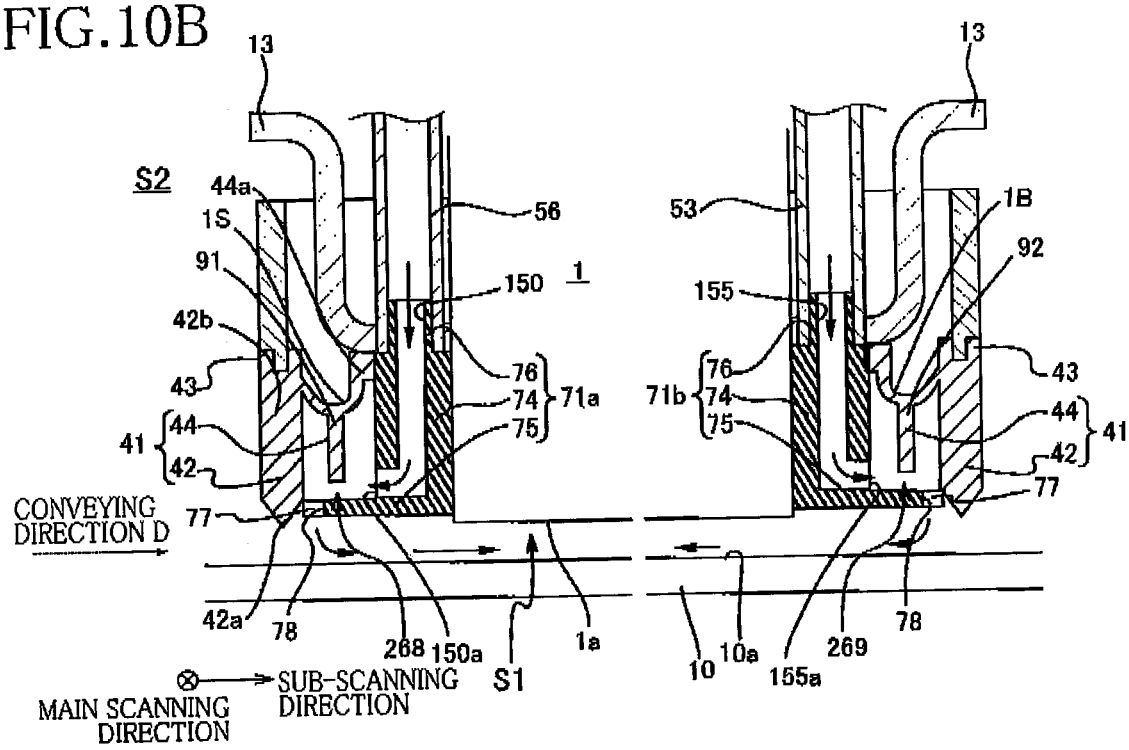

As illustrated in FIGS. 9A and 9B, the separator 41 and the side cover 70 are arranged so as to be symmetrical to each other about a center of the head main body 3. As illustrated in FIGS. 10A and 10B, the side cover 70 includes two long portions 71 (71*a*, 71*b*) extending in the main scanning direction. Each of the two long portions 71 is constituted by the fixed portion 74, the brim portion 75, and an upper projecting portion 76.

In an upstream half portion of the head 1, the upper projecting portion 76 is provided upright on an upper face of the fixed portion 74 at its central portion in the longitudinal direction. An air supply channel 150 is formed in this upper projecting portion 76. The air supply channel 150 connects between an upper face of the upper projecting portion 76 and an opening 150*a* formed in a side face of the fixed portion 74. The tube 56 is connected to the upper projecting portion 76. A rib portion 93 projects from an upstream side face of the fixed portion 74 in the conveying direction D at one end portion of the fixed portion 74 in the longitudinal direction. In the closed state, an upstream side face of the rib portion 93 can contact an entire inner face of the separator 41 above a distal end portion of the brim portion 75 (i.e., an area of the inner face of the separator 41 between a basal end portion of the diaphragm 44 and a position where the distal end portion of the brim portion 75 contacts the separator 41). The brim portion 75 includes a plurality of support portions 77 at an outer circumferential end thereof. Each of the support portions 77 projects horizontally from an end face of the brim portion 75, and a distal end of each support portion 77 is held in contact with the inner face of the lip member 42. It is noted that the air supply channel 150 is also one example of the air channel to which the humid air is supplied from the outside.

In the upstream half portion, an upstream contact portion 91 is provided on the diaphragm 44 of the separator 41. The upstream contact portion 91 is a projecting portion extending downward from the upstream side face 1S to the brim portion 75 and also extending in the longitudinal direction. As illustrated in FIG. 9B, one end of the upstream contact portion 91 is held in contact with an inner face of one end portion of the lip member 42 in the longitudinal direction, and the other end of the upstream contact portion 91 is held in contact with an inner face of the other end portion of the lip member 42 in the longitudinal direction. When seen in the direction perpendicular to the ejection face 1*a*, the upstream contact portion 91 is interposed between the fixed portion 74 and the support portions 77 in the conveying direction. Clearances 78 are formed each between corresponding adjacent two of the support portions 77.

With the upward and downward movement of the lip member 42, the upstream contact portion 91 is moved between a first defining position illustrated in FIG. 10A and a second defining position illustrated in FIG. 10B. The first defining position corresponds to the contact position of the lip member 42 and is associated with the capping operation. The second defining position corresponds to the distant position of the lip member 42 and is associated with the uncapping operation.

At the first defining position, a lower end of the upstream contact portion 91 is held in contact with the brim portion 75. Thus, a supply-side air channel 95 as one example of a fourth air channel extending in the longitudinal direction is defined by the brim portion 75, the fixed portion 74, and the upstream contact portion 91. One open end of the supply-side air channel 95 is closed by a closing surface 93*a* of the rib portion 93, a central portion of the supply-side air channel 95 communicates with the air supply channel 150 via the opening 150*a*, and the other open end of the supply-side air channel 95 is the first supply opening portion 265. The first supply opening portion 265 communicates with the ejection space S1 via the clearance(s) 78 defined by the support portions 77 near the other open end of the supply-side air channel 95.

At the second defining position, as illustrated in FIG. 10B, the lower end of the upstream contact portion 91 is spaced apart from the brim portion 75. In this state, the second supply opening portion 268 is defined by the upstream contact portion 91 and the brim portion 75. The second supply opening portion 268 extends in the longitudinal direction along the upstream side face 1S and communicates with the air supply channel 150 via the opening 150*a* formed in a central portion of the upstream side face 1S. The second supply opening portion 268 communicates, mainly at an upstream side, with the ejection space S1 via the clearances 78 defined by the support portions 77. In the present embodiment, the supply-opening switching mechanism is constituted by the upstream contact portion 91 and the rib portion 93.

While the construction of the upstream half portion of the head 1 has been explained above, a downstream half portion has a construction similar to that of the upstream half portion of the head 1 because the separator 41 and the side cover 70 are symmetrical to each other as described above. The side cover 70 is constituted by the long portion 71*b*, the fixed portion 74, the brim portion 75, and the upper projecting portion 76. The tube 53 is connected to the upper projecting portion 76. The fixed portion 74 includes: an air discharge channel 155 corresponding to the air supply channel 150; an opening 155*a* corresponding to the opening 150*a*; the support portions 77; the clearances 78; and a rib portion 94 having a closing surface 94*a*. The rib portion 94 is located at a position symmetrical to the rib portion 93 about the center of the head 1. The diaphragm 44 includes a downstream contact portion 92 corresponding to the upstream contact portion 91. In the downstream half portion of the head 1, when the downstream contact portion 92 is located at the first defining position, as illustrated in FIG. 10A, a lower end of the downstream contact portion 92 is held in contact with the brim portion 75. In this state, a discharge-side air channel 96 extending in the longitudinal direction is defined by the brim portion 75, the fixed portion 74, and the downstream contact portion 92. One open end of the discharge-side air channel 96 is closed by the closing surface 94*a* of the rib portion 94, a central portion of the discharge-side air channel 96 communicates with the air discharge channel 155 via the opening 155*a*, and the other open end of the discharge-side air channel 96 is a discharge opening portion 285. The discharge opening portion 285 communicates with the ejection space S1 via the clearance(s) 78 defined by the support portions 77 near the other open end of the discharge-side air channel 96. It is noted that the first supply opening portion 265 of the upstream half portion is provided on a side near the one open end on which the rib portion 94 is located, and the rib portion 93 of the upstream half portion is provided on a side near the other open end on which the discharge opening portion 285 is located.

When the downstream contact portion 92 is located at the second defining position, as illustrated in FIG. 10B, the lower end of the downstream contact portion 92 is spaced apart from the brim portion 75. In this state, the third supply opening portion 269 is defined by the downstream contact portion 92 and the brim portion 75. The third supply opening portion 269 communicates with the ejection space S1 via the clearances 78, and the humid air is supplied into the third supply opening portion 269 like the second supply opening portion 268.

For the recording-state humidifying operation, the humidifying mechanism 50 includes not only the four tubes 53-56 but also a communication tube, not shown, for communicably connecting between the tube 53 and the tube 56. Also, a first open/close valve, not shown, is provided on the communication tube. A second open/close valve, not shown, is provided on the tube 53 at a position between the communication tube and the air discharge channel 155.

There will be next explained a series of the capping operation and the nonoperating-state humidifying operation in the printer 101 having the above-described construction.

When the capping operation is performed, as illustrated in FIGS. 9A, 9B, and 10A, the lower end of the upstream contact portion 91 is brought into contact with the brim portion 75 of the long portion 71*a* under the control of the controller 100 to define the supply-side air channel 95. The one open end of the supply-side air channel 95 is closed by the closing surface 93*a* of the rib portion 93, and the other open end of the supply-side air channel 95 becomes the first supply opening portion 265. Also, the lower end of the downstream contact portion 92 is brought into contact with the brim portion 75 of the long portion 71*b* to define the discharge-side air channel 96. The open end of the discharge-side air channel 96 near the first supply opening portion 265 is closed by the closing surface 94*a* of the rib portion 94, and the other open end of the discharge-side air channel 96 becomes the discharge opening portion 285.

When the nonoperating-state humidifying operation is performed next, the three-way valve 59 establishes the communication between the tube 54 and the tube 53 and the first open/close valve of the communication tube is closed under the control of the controller 100. The controller 100 then drives the pump 58 to transfer the air in the direction indicated by white arrows in FIGS. 9A, 9B, and 10A. The humid air in the upper space of the tank 57 is supplied to the supply-side air channel 95 via the air supply channel 150. The humid air is then supplied from the first supply opening portion 265 into the ejection space S1 via the clearances 78. The air in the ejection space S1 is delivered in the longitudinal direction from the first supply opening portion 265 toward the discharge opening portion 285 while replaced with the humid air. Also, the air in the ejection space S1 is sucked by the pump 58 and flows from the discharge opening portion 285 toward the tank 57. The air is humidified in the lower space of the tank 57 and moved to the upper space. The produced humid air is supplied to the ejection space S1 while the pump 58 is being driven. The series of the capping operation and the nonoperating-state humidifying operation have been explained. It is noted that, when the ejection space S1 is in the closed state, the humid air supplied from the air supply channel 150 is supplied to the supply-side air channel 95 as described above, and accordingly an amount of the humid air supplied to the first supply opening portion 265 is larger than that of the humid air supplied to the second supply opening portion 268.

There will be next explained a series of the uncapping operation and the recording-state humidifying operation in the printer 101.

Figure 9C:
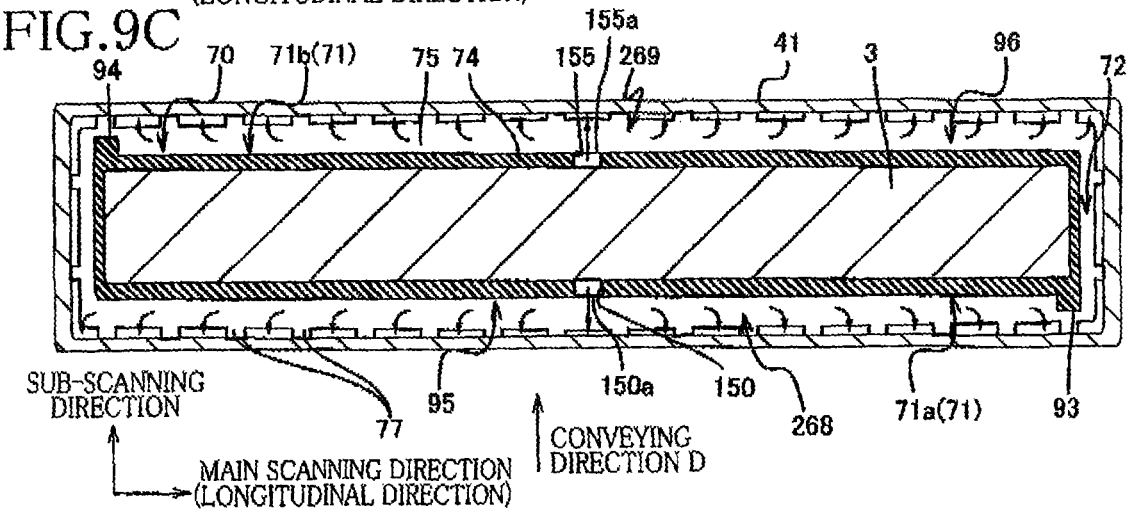
FIG. 9C is a plan view illustrating a head in a recording-state humidifying operation.

When the uncapping operation is performed, as illustrated in FIGS. 9C and 10B, the lower end of the upstream contact portion 91 is spaced apart from the brim portion 75 of the long portion 71*a* under the control of the controller 100 to define the second supply opening portion 268. Also, the lower end of the downstream contact portion 92 is spaced apart from the brim portion 75 of the long portion 71*b* to define the third supply opening portion 269.

When the recording-state humidifying operation is performed in the image recording operation, the three-way valve 59 establishes the communication between the tube 54 and the tube 55 and the first open/close valve of the communication tube is opened under the control of the controller 100. The controller 100 then drives the pump 58 to transfer the air in the direction indicated by black arrows in FIGS. 9C and 10B. The humid air in the upper space of the tank 57 is supplied to the air supply channel 150 and the air discharge channel 155. The humid air is then supplied into the ejection space S1 from the second supply opening portion 268 and the third supply opening portion 269 via the clearances 78. As a result, it is possible to reliably suppress the drying of the ejection openings 108, thereby reducing consumption of the ink. It is noted that, when the ejection space S1 is in the open state, the humid air supplied from the air supply channel 150 and the air discharge channel 155 is supplied into the ejection space S1 mainly through the clearances 78 as described above, and accordingly an amount of the humid air supplied to the second supply opening portion 268 and the third supply opening portion 269 is larger than that of the humid air supplied to the first supply opening portion 265. That is, the supply-opening switching mechanism is configured to change resistance of a channel that fluidically couples the air supply channel 150 and the second supply opening portion 268 with each other. Specifically, when the ejection space S1 in the closed state, the lower end of the downstream contact portion 92 is held in contact with the brim portion 75 of the long portion 71*b*, and the open end of the discharge-side air channel 96 near the first supply opening portion 265 is closed by the closing surface 94*a* of the rib portion 94, thereby changing the resistance of the channel fluidically coupling the air supply channel 150 and the second supply opening portion 268 with each other.

In the present embodiment described above, the first supply opening portion 265 and the second supply opening portion 268 are formed by the components (i.e., the separator 41 and the side cover 70) conventionally used for the printer 101, resulting in a smaller size of the printer 101.

Also, in the recording-state humidifying operation, the humid air is supplied from the third supply opening portion 269 extending in the longitudinal direction along a downstream side face 1B, making it possible to reliably suppress the drying of the ejection openings 108.

Also, the switching of the destination of the supply of the humid air by the supply-opening switching mechanism is performed with the movement of the lip member 42 between the contact position and the distant position, whereby the switching can be easily performed.

While the embodiments of the present invention have been described above, it is to be understood that the invention is not limited to the details of the illustrated embodiments, but may be embodied with various changes and modifications, which may occur to those skilled in the art, without departing from the spirit and scope of the invention. For example, the above-described first-third embodiments may be combined in any suitable combinations.

Also, the supply-opening switching mechanism for switching the destination of the supply of the humid air is not limited to that in the above-described embodiments. For example, the three-way valve may be a three-way electromagnetic valve in the above-described second embodiment. In this case, the controller 100 directly controls the valve to switch the channel.

Also, the recording-state humidifying operation is performed in the image recording operation in the above-described embodiments, but may be performed when the image recording operation is not performed as long as the separator 41 is in the open state in which the ejection space S1 is open to the outside space S2.

The upstream contact portion 91 and the downstream contact portion 92 are provided on the diaphragm 44 in the above-described third embodiment, but as modifications may be provided on the lip member 42 and may be provided on both of the lip member 42 and the diaphragm 44. Also, the rib portions 93, 94 are provided on the fixed portion 74 in the above-described embodiment but may be provided on the upstream contact portion 91 or the downstream contact portion 92 and may be provided on the brim portion 75, the lip member 42 or the diaphragm 44. Also, the rib portions 93, 94 may be provided on two or more of these components.

In the above-described embodiments, the present invention is applied to the conveyor mechanism of the side registration type but may be applied to a conveyor mechanism of a center registration type. The sheet P is conveyed such that its center line extending in the conveying direction generally coincides with a center of an area of the ejection openings 108 in the longitudinal direction of the head 1. When a small size of the sheet P is being conveyed, the ejection openings 108 at the opposite end portions in the longitudinal direction are always exposed to air, so that these ejection openings 108 dry in the image recording. The above-described two effects are on the ejection space S1 in the closed state. As a result, the ink in the ejection openings 108 at opposite end portions in the longitudinal direction dries speedily, so that deterioration of the recording quality becomes recognizable early. In the conveyor mechanism of the center registration type, the ejection openings 108 are interposed between the first supply opening portion 65 and the discharge opening portion 85 in the longitudinal direction. Furthermore, a channel switching valve is provided on a tube connecting between the humid-air producing portion and the humid-air supplying portion to switch the destination of the supply of the humid air between the first supply opening portion 65 and the discharge opening portion 85. As a result, it is possible to effectively suppress drying of the ejection openings 108 located in the opposite end portions in the longitudinal direction.

In the above-described embodiments, the separator 41 of the cap mechanism 40 (specifically, the lip member 42 and the diaphragm 44) is provided on a side near the head 1 and separated from the facing member 10, but the present invention is not limited to this design. For example, the separator may be formed of an elastic material and constituted by a facing member and a lip member which are integral with each other. In this design, the diaphragm 44 is not necessary. The facing member can face the ejection face 1*a*, and the lip member is provided upright on an outer circumferential edge of the facing member. In the closed state, a distal end of the lip member is held in contact with the ejection face 1*a* to define the ejection space S1. The second supply pipe 63 is not necessary, either. As in the above-described embodiments, the third supply pipe 66 is provided near the upstream side face of the head 1 in the conveying direction. On the other hand, two openings respectively corresponding to the first supply opening portion 65 and the discharge opening portion 85 are formed on a side near the separator, e.g., end portions of the facing member. In this design, the supply-opening switching mechanism may be disposed outside the ejection space S1. For example, a bifurcated tube is connected to the upper space of the tank 57, and a valve is provided on a bifurcated portion, i.e., a branch portion of the tube. This valve switches the destination of the supply of the humid air.

As a modification of this design, the separator may include two first supply opening portions and one discharge opening portion. For example, the two first supply opening portions are arranged in opposite end portions of the facing member in the longitudinal direction, and the discharge opening portion is disposed in a central portion of the facing member in the longitudinal direction. When seen in the direction perpendicular to the ejection face 1*a*, the discharge opening portion is located at a center, and the ejection openings 108 are interposed between the first supply opening portions respectively located at the opposite end portions in the longitudinal direction. As a result, opposite end portions of the ejection space S1 are respectively opposed to the first supply opening portions, making it possible to effectively humidify the ejection openings near the opposite end portions which tend to dry. Also, since a distance between each supply opening and the discharge opening is a relatively short, it is possible to humidify all the ejection openings uniformly. In this design, a trifurcated tube is connected to the upper space of the tank 57.

Also, in a configuration having this separator, the supply-opening switching mechanism may be designed such that the ejection space S1 can accommodate the supply-opening switching mechanism. The third supply pipe 66 is formed in the channel unit 9 (or in the side cover 70) so as to extend in the longitudinal direction. A plurality of openings communicate from the ejection face 1*a* to the third supply pipe 66 and are arranged along an upstream edge of the ejection face 1*a* in the conveying direction. A partition wall is provided upright on the separator. The partition wall partly constitutes the supply-opening switching mechanism and can contact the ejection face 1*a* in the closed state. The partition wall extends parallel to the upstream lip portion of the lip member in the conveying direction. When seen in the direction perpendicular to the ejection face 1*a*, the plurality of openings are interposed between the partition wall and the lip member. The partition wall are interposed between these openings and the ejection openings 108. In the closed state, the partition wall constitutes an air channel with the upstream lip portion, the facing member, and the ejection face 1*a*. This air channel communicates with the plurality of openings and communicates with the ejection space S1 at an end portion of the partition wall in the longitudinal direction.

Here, the facing member may have the discharge opening portion. In a case where the facing member has, at opposite end portions of the partition wall, communication openings (i.e., the first supply opening portions) for communicating with the ejection space S1, the discharge opening portion is preferably disposed on a central portion of the facing member in the longitudinal direction. A communication opening is formed only at one end portion of the partition wall (noted that the other end portion of the partition wall is connected to the lip portion), the discharge opening portion is preferably disposed near the other end portion. In the former case, it is possible to effectively humidify the ejection openings at the opposite end portions in the longitudinal direction and to humidify all the ejection openings uniformly. As thus described, the switching of the ejection space S1 to the closed state switches the supply opening portion for the ejection space S1, from the opening communicating with the third supply pipe 66, i.e., the second supply opening portion to the communication opening for the air channel, i.e., the first supply opening portion. It is noted that the discharge opening portion may be provided on a head side.

As a modification of this design, the partition wall is disposed so as to be opposed to the plurality of openings when seen in the direction perpendicular to the ejection face 1*a*. In the closed state, the partition wall seals all the openings except for one opening. In a case where this one opening is located at one end of the arrangement of the openings, the discharge opening portion is disposed near the other end of the separator. The discharge opening portion may be located on any of the head side and the facing-member side. As another modification, this partition wall may be designed to seal all the openings except for openings at opposite ends of the arrangement in the closed state. The discharge opening portion is disposed on a central portion of the separator in the longitudinal direction and may be formed on any of the head side and the facing-member side.

The present invention is applicable to any of a line printer and a serial printer and applicable not only to the printer but also to devices such as a facsimile machine and a copying machine. Also, the present invention is applicable to a liquid ejection apparatus configured to eject liquid other than the ink to perform the recording. The recording medium is not limited to the sheet P, and various recordable media may be used. The present invention may be applied to a liquid ejection apparatus of any ink ejection method. For example, the piezoelectric elements are used in the present embodiment, but various methods may be used such as a resistance heating method and an electrostatic capacity method.

What is claimed is:

1. A liquid ejection apparatus, comprising:

a head elongated in a longitudinal direction perpendicular to a conveying direction in which a recording medium is conveyed, the head comprising: an upstream side face in the conveying direction; and an ejection face comprising a plurality of ejection openings, the head being configured to eject liquid onto the recording medium from the plurality of ejection openings, an ejection space being opposed to the plurality of ejection openings;

a cap mechanism comprising: a facing member capable of facing the ejection face; and a separator capable of separating the ejection space and an outside space, the cap mechanism being configured to switch a state of the ejection space between a closed state in which the ejection space is enclosed with the ejection face, the facing member, and the separator and an open state in which the ejection space is open to the outside space;

a first supply opening portion and a discharge opening portion each communicating with the ejection space being in the closed state, the first supply opening portion and the discharge opening portion being arranged on opposite sides of the plurality of ejection openings in the longitudinal direction when viewed in a direction perpendicular to the ejection face;

a second supply opening portion provided along the upstream side face of the head and communicating with the ejection space being in the open state;

a humidifying mechanism configured to supply humid air to at least one of the first supply opening portion and the second supply opening portion, wherein, when the ejection space is in the closed state, an amount of the humid air supplied to the first supply opening portion is greater than that of the humid air supplied to the second supply opening portion, and wherein, when the ejection space is in the open state, an amount of the humid air supplied to the second supply opening portion is greater than that of the humid air supplied to the first supply opening portion.

2. The liquid ejection apparatus according to claim 1, wherein the humidifying mechanism comprises an air channel to which the humid air is supplied from an outside, and wherein the liquid ejection apparatus further comprises a supply-opening switching mechanism configured to, by changing resistance of at least one of: a channel that couples the air channel and the first supply opening portion with each other, and a channel that couples the air channel and the second supply opening portion with each other, switch between a state in which the amount of the humid air supplied from the humidifying mechanism to the first supply opening portion is greater than that of the humid air supplied from the humidifying mechanism to the second supply opening portion and a state in which the amount of the humid air supplied from the humidifying mechanism to the second supply opening portion is greater than that of the humid air supplied from the humidifying mechanism to the first supply opening portion.

3. The liquid ejection apparatus according to claim 2, wherein the supply-opening switching mechanism is enclosed by the cap mechanism when the ejection space is in the closed state.

4. The liquid ejection apparatus according to claim 2, wherein the cap mechanism comprises:

the separator comprising: a lip member enclosing the head; and a flexible diaphragm connecting between the lip member and the head; and a moving mechanism configured to move the lip member between a contact position at which the lip member is held in contact with the facing member and a distant position at which the lip member is spaced apart from the facing member, and wherein the supply-opening switching mechanism is configured to switch between the state in which an amount of the humid air supplied from the humidifying mechanism to the first supply opening portion is greater than that of the humid air supplied from the humidifying mechanism to the second supply opening portion and the state in which an amount of the humid air supplied from the humidifying mechanism to the second supply opening portion is greater than that of the humid air supplied from the humidifying mechanism to the first supply opening portion, with the movement of the lip member between the contact position and the distant position.

5. The liquid ejection apparatus according to claim 4, wherein the second supply opening portion is disposed downstream of an upstream-side inner face of the lip member in the conveying direction.

6. The liquid ejection apparatus according to claim 2, wherein the humidifying mechanism comprises: a first air channel; a second air channel comprising the first supply opening portion and communicable with the first air channel; and a third air channel comprising the second supply opening portion and communicable with the first air channel, and wherein the supply-opening switching mechanism comprises a switching valve configured to selectively switch between a state in which the first air channel communicates with the second air channel and a state in which the first air channel communicates with the third air channel.

7. The liquid ejection apparatus according to claim 6, wherein the cap mechanism comprises:

the separator comprising: a lip member enclosing the head; and a flexible diaphragm connecting between the lip member and the head; and a moving mechanism configured to move the lip member between a contact position at which the lip member is held in contact with the facing member and a distant position at which the lip member is spaced apart from the facing member, wherein the switching valve is a three-way valve comprising a closing member movable by a force that is produced by movement of the lip member between the contact position and the distant position, and movement of the closing member causes the switching valve to selectively switch between a state in which the first air channel communicates with the second air channel and a state in which the first air channel communicates with the third air channel.

8. The liquid ejection apparatus according to claim 6, wherein a channel resistance of the third air channel decreases from an upstream side in the third air channel toward a downstream side in the third air channel in a direction of flow of the humid air.

9. The liquid ejection apparatus according to claim 1, wherein the first supply opening portion comprises a first supply opening, wherein the humidifying mechanism comprises a first air channel, a second air channel and a third air channel, wherein one end of the second air channel communicates with the first air channel, and another end of the second air channel comprises the first supply opening portion, and wherein one end of the third air channel communicates with the second air channel, and the third air channel comprises the second supply opening portion, and wherein an inner face of the separator comprises a closing surface that is spaced apart from the first supply opening when the ejection space is in the closed state and that closes the first supply opening when the ejection space is in the open state.

10. The liquid ejection apparatus according to claim 9, wherein the cap mechanism comprises:

the separator comprising: a lip member enclosing the head a flexible diaphragm connecting between the lip member and the head; and a projection projecting inwardly from at least one of the lip member and the diaphragm; and a moving mechanism configured to move the lip member between a contact position at which the lip member is held in contact with the facing member and a distant position at which the lip member is spaced apart from the facing member, and wherein the projection comprises the closing surface that is spaced apart from the first supply opening when the lip member is located at the contact position and that is held in contact with the first supply opening to close the first supply opening when the lip member is located at the distant position.

11. The liquid ejection apparatus according to claim 9, wherein a channel resistance of the third air channel decreases from an upstream side in the third air channel toward a downstream side in the third air channel in a direction of flow of the humid air.

12. The liquid ejection apparatus according to claim 11, wherein the second supply opening portion comprises a plurality of supply openings arranged spaced apart from one another in the longitudinal direction, and wherein, in each two of the plurality of supply openings, a downstream one of the plurality of supply openings has an opening area greater in size than that of an upstream one of the plurality of supply openings.

13. The liquid ejection apparatus according to claim 1, wherein the cap mechanism comprises:

the separator comprising: a lip member enclosing the head; and a flexible diaphragm connecting between the lip member and the head; and a moving mechanism configured to move the lip member between a contact position at which the lip member is held in contact with the facing member and a distant position at which the lip member is spaced apart from the facing member, wherein the head comprises: a fixed portion to which the diaphragm is coupled at the upstream side face of the head; and a projecting portion extending in the longitudinal direction and projecting from a lower side of the fixed portion toward an upstream side in the conveying direction, wherein the separator comprises a contact portion extending along the upstream side face of the head and held in contact with the projecting portion, when the ejection space is in the closed state, to define a fourth air channel that comprises one open end located near the discharge opening portion and another open end as the first supply opening portion, wherein the liquid ejection apparatus further comprises a closing surface capable of closing the one open end of the fourth air channel defined by the contact portion, wherein the humidifying mechanism comprises a supply channel communicable with the fourth air channel, and wherein, when the ejection space is in the open state, the contact portion is spaced apart from the projecting portion such that the contact portion and the projecting portion define the second supply opening portion extending in the longitudinal direction along the upstream side face of the head.

14. The liquid ejection apparatus according to claim 13, wherein the contact portion is provided on at least one of the lip member and the diaphragm and configured to define the fourth air channel with the upstream side face of the head by contacting an upper face of the projecting portion when the lip member is located at the contact position, and wherein a rib portion is provided on one of the fixed portion, the projecting portion, the lip member, the diaphragm, and the contact portion, and the rib portion comprises the closing surface.

* * * * *